US012623117B2

(12) United States Patent
Shapiro et al.

(10) Patent No.: US 12,623,117 B2
(45) Date of Patent: May 12, 2026

(54) COLD START CALIBRATION

(71) Applicant: Tonal Systems, Inc., San Francisco, CA (US)

(72) Inventors: Joshua Ben Shapiro, Toronto (CA); Giuseppe Barbalinardo, Berkeley, CA (US)

(73) Assignee: Tonal Systems, Inc., San Francisco, CA (US)

( * ) Notice: Subject to any disclaimer, the term of this patent is extended or adjusted under 35 U.S.C. 154(b) by 380 days.

(21) Appl. No.: 18/215,149

(22) Filed: Jun. 27, 2023

(65) Prior Publication Data

US 2025/0001257 A1 Jan. 2, 2025

(51) Int. Cl.
*A63B 24/00* (2006.01)

(52) U.S. Cl.
CPC .. *A63B 24/0062* (2013.01); *A63B 2024/0068* (2013.01); *A63B 2220/20* (2013.01); *A63B 2220/30* (2013.01); *A63B 2220/52* (2013.01); *A63B 2225/02* (2013.01)

(58) Field of Classification Search
CPC ..... A63B 24/0062; A63B 24/0087; A63B 2024/0068; A63B 2024/0093; A63B 2220/20; A63B 2220/30; A63B 2220/52; A63B 2225/02; A63B 2225/20; A63B 2225/50
See application file for complete search history.

(56) References Cited

U.S. PATENT DOCUMENTS

| | | | | |
|---|---|---|---|---|
| 11,621,067 | B1 * | 4/2023 | Nolan | G16H 50/20 482/8 |
| 12,347,542 | B2 * | 7/2025 | Chen | G16H 20/30 |
| 12,380,984 | B2 * | 8/2025 | Rosenberg | G16H 50/70 |
| 2007/0135264 | A1 * | 6/2007 | Rosenberg | A63B 24/0084 482/8 |
| 2008/0161733 | A1 * | 7/2008 | Einav | A63B 21/012 482/9 |
| 2021/0008413 | A1 * | 1/2021 | Asikainen | G06F 3/0304 |

* cited by examiner

*Primary Examiner* — Joshua Lee
(74) *Attorney, Agent, or Firm* — Van Pelt, Yi & James LLP

(57) ABSTRACT

A first set of performance information pertaining to a previous performance of a first exercise movement is received, the first set of performance information comprising a first weight, a first velocity, and a first range of motion. Target parameters for a target exercise movement based at least in part on the first set of performance information is predicted, wherein the target exercise movement is different from the first exercise movement. An exercise machine is configured to facilitate performing of the target exercise movement based at least in part on the predicted target parameters.

20 Claims, 8 Drawing Sheets

COLD START CALIBRATION

BACKGROUND OF THE INVENTION

Strength training may be a poorly understood activity for a strength training user. One aspect of this is lack of knowledge about assessing one's own strength. When starting a strength training regimen, this lack of knowledge may have the strength training user choosing an inappropriate weight level for a given movement. This may cause a dangerous injury for a user and/or discourage a user because of a lack of progress.

BRIEF DESCRIPTION OF THE DRAWINGS

Various embodiments of the invention are disclosed in the following detailed description and the accompanying drawings.

DETAILED DESCRIPTION

Figure 1:
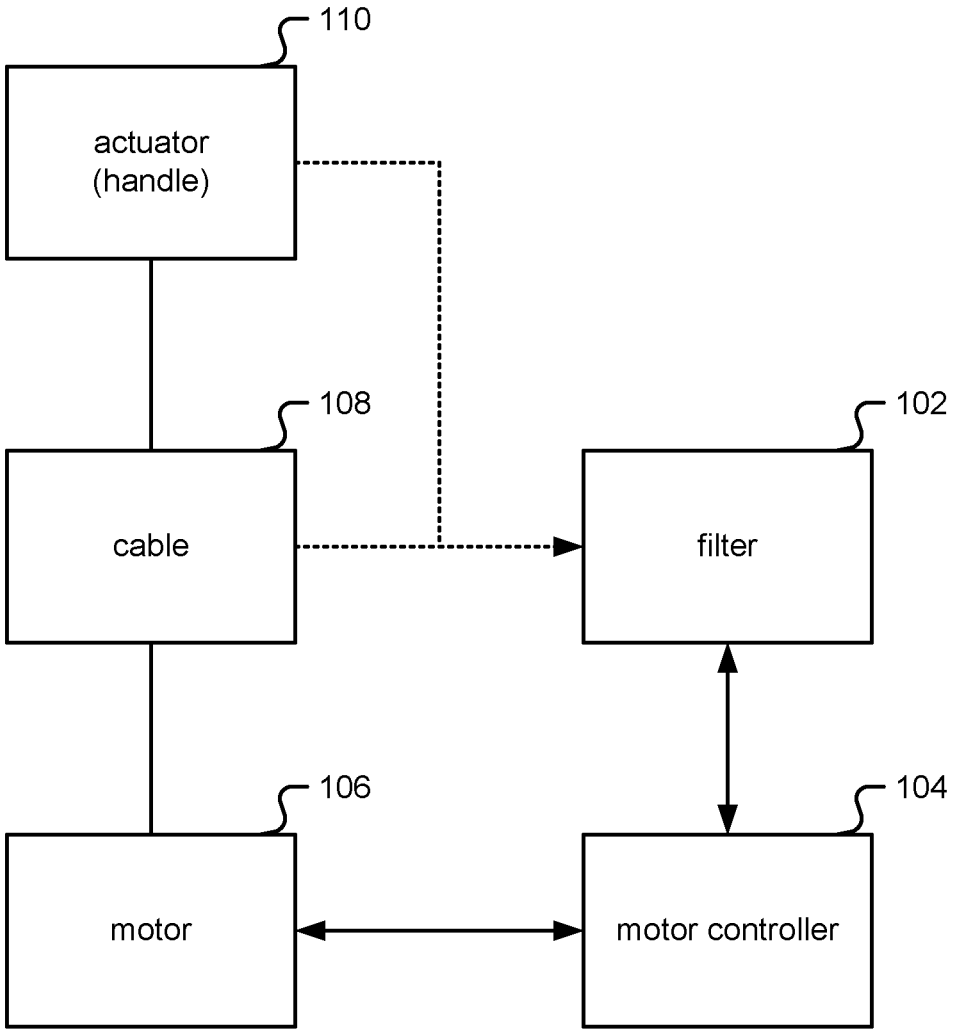
FIG. 1 is a block diagram illustrating an embodiment of an exercise machine capable of digital strength training.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Efficient strength determination and/or strength calibration of a strength training user is disclosed. The user's weight capability on a target exercise movement they have not performed is estimated based on analysis of a multi-dimensional performance capture on a few historical exercise movements for the user as well as a population-level performance capture on the few historical exercise movements and the target exercise movement.

For example, the user may have a first captured performance of weight, velocity, and range of motion for a bench press movement, and a second captured performance of weight, velocity, and range of motion for a gobble squat movement, and may wish to target a bicep curl movement next without any previous performance history. Based on analysis of the user's first and second captured performance and population-level performance across the bench press movement, gobble squat movement, and bicep curl movement, a predicted weight capability for the user for the bicep curl movement is determined.

Progressive weight mode is disclosed. A strength training user may traditionally use an isokinetic weight mode to directly model the user's weight capacity for a given movement velocity as a force velocity curve, in part to determine a one rep maximum for the user. Progressive weight mode is an improvement in user comfort over isokinetic weight mode that uses a higher velocity calibration with lower weight to model the force velocity curve. Another improvement with progressive weight mode is that a "target speed" referred to herein as a threshold percentage of the user maximum concentric velocity for a given movement may be determined.

Suggested Weights. Suggesting appropriate weights and/or resistance for a user's exercise set using an exercise machine is disclosed. In one embodiment, the exercise machine comprises a motor wherein the torque of the motor is associated with resistance for the exercise machine, for example emulating a "digital weight" for the user of the exercise machine.

The disclosed techniques may thus be used with any machine where motor torque is associated with resistance, for example using a digital strength training technique as described in U.S. Pat. No. 10,661,112 entitled DIGITAL STRENGTH TRAINING filed Jul. 20, 2017, and U.S. Pat. No. 10,335,626 entitled EXERCISE MACHINE WITH PANCAKE MOTOR filed Jul. 2, 2019, which are incorporated herein by reference for all purposes. Any person of ordinary skill in the art understands that the strength determination techniques may be used without limitation with other machines capable of associating motor torque with resistance, and the digital strength trainer is given merely as an example embodiment.

Using a characteristic of a user's workout to determine a suggested weight for a next exercise movement is disclosed.

Determining suggested weights for an upcoming repetition (as referred to herein as a "rep") and/or set of repetitions (as referred to herein as a "set") based at least in part on previous sets and/or reps is disclosed. An indication of workout intensity, for example weight percentage, associated with a previous set of an exercise movement is evaluated. In one embodiment, the indication of workout intensity associated with the previous set of the exercise movement is evaluated against a threshold. Based at least in part on the evaluation, performance information pertaining to the previous set of the exercise movement may be used to determine a suggested weight for an upcoming set of the exercise movement. Torque of the exercise machine motor may then be controlled based at least in part on the suggested weight.

Determining a suggested weight for duration-based sets is disclosed. After determining that a duration-based set of an exercise movement is to be performed, a repetition goal is determined based at least in part on one or more characteristics of the duration-based set of the exercise movement. In one embodiment, a suggested weight for the duration-based set of the exercise movement is determined based at least in part on the repetition goal. Torque of the exercise machine motor may then be controlled based at least in part on the suggested weight.

Determining a suggested weight based on relative muscle volume is disclosed. After identifying a plurality of muscle groups utilized across a plurality of exercise movements included in a workout, a corresponding relative muscle volume for each muscle group in the plurality of muscle groups may be determined. In one embodiment, a suggested weight for an exercise movement in the plurality of exercise movements included in the workout is determined based at least in part on a relative muscle volume determined for an associated muscle group. Torque of the exercise machine motor may then be controlled based at least in part on the suggested weight.

Before suggesting weights, an initial strength calibration may be used, for example using strength calibration as described in U.S. Pat. No. 10,874,905 entitled STRENGTH CALIBRATION filed Feb. 14, 2019, which is incorporated herein by reference for all purposes.

Strength Determination/Calibration. Strength determination, also referred to herein as "calibration," of a user based on only a few specific movements may be used as a starting basis for a strength level for the user for hundreds of strength training movements, for getting a user started on a strength training machine, and/or for calibrating progress. This strength determination may be used as a starting basis for a strength level for the user for hundreds of strength training movements, for getting a user started on a strength training machine, and/or for calibrating progress. The strength determination is based at least in part on an "isokinetic seed movement". An isokinetic seed movement as referred to herein is a movement wherein the user is allowed to move against a machine's resistance at a prescribed constant speed during a movement's concentric, or eccentric, phase, and the machine's resistance dynamically changes to match the user's applied force. The user's produced force at the prescribed speed is mapped to a predetermined force-velocity profile/plot ("FVP") to determine strength, for example an estimated one rep maximum ("1eRM") for the user for the muscle group associated with the isokinetic seed movement, wherein the 1eRM is an estimate of the one rep maximum, or how much weight a user could maximally exercise for a given movement for a single cycle, that is without further repetition. This 1eRM may be used to recommend starting weights for future non-isokinetic movements, for example regular strength training movements.

Traditionally, one method of calibrating a user's strength is to ask a user to perform one or more movements, and do so to the point of physical failure. However, this approach is manual, painful to users, and may even injure some users. An improvement of the described is the providing of an automated way of calibrating a user's strength level that additionally reduces a risk of injury for the user.

The described techniques may be used with any machine capable of these, or other, isokinetic seed movements. Any person of ordinary skill in the art understands that the strength determination techniques may be used without limitation with other machines capable of isokinetic seed movements, and the digital strength trainer is given merely as an example embodiment.

FIG. 1 is a block diagram illustrating an embodiment of an exercise machine capable of digital strength training. The exercise machine includes the following:

- a controller circuit (104), which may include a processor, inverter, pulse-width-modulator, and/or a Variable Frequency Drive (VFD);
- a motor (106), for example a three-phase brushless DC driven by the controller circuit;
- a spool with a cable (108) wrapped around the spool and coupled to the spool. On the other end of the cable an actuator/handle (110) is coupled in order for a user to grip and pull on. The spool is coupled to the motor (106) either directly or via a shaft/belt/chain/gear mechanism. Throughout this specification, a spool may be also referred to as a "hub";
- a filter (102), to digitally control the controller circuit (104) based on receiving information from the cable (108) and/or actuator (110);
- optionally (not shown in FIG. 1) a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox, and/or a dual motor may be used in place of a gearbox;
- one or more of the following sensors (not shown in FIG. 1): a position encoder; a sensor to measure position of the actuator (110). Examples of position encoders include a hall effect shaft encoder, grey-code encoder on the motor/spool/cable (108), an accelerometer in the actuator/handle (110), optical sensors, position measurement sensors/methods built directly into the motor (106), and/or optical encoders. In one embodiment, an optical encoder is used with an encoding pattern that uses phase to determine direction associated with the low resolution encoder. Other options that measure back-EMF (back electromagnetic force) from the motor (106) in order to calculate position also exist;
- a motor power sensor; a sensor to measure voltage and/or current being consumed by the motor (106);
- a user tension sensor; a torque/tension/strain sensor and/or gauge to measure how much tension/force is being applied to the actuator (110) by the user. In one embodiment, a tension sensor is built into the cable (108). Alternatively, a strain gauge is built into the motor mount holding the motor (106). As the user pulls on the actuator (110), this translates into strain on the motor mount which is measured using a strain gauge in a Wheatstone bridge configuration. In another embodiment, the cable (108) is guided through a pulley coupled to a load cell. In another embodiment, a belt coupling the motor (106) and cable spool or gearbox (108) is guided through a pulley coupled to a load cell. In another embodiment, the resistance generated by the motor (106) is characterized based on the voltage, current, or frequency input to the motor.

In one embodiment, a three-phase brushless DC motor (106) is used with the following:

- a controller circuit (104) combined with filter (102) comprising:
  - a processor that runs software instructions;
  - three pulse width modulators (PWMs), each with two channels, modulated at 20 kHz;
  - six transistors in an H-Bridge configuration coupled to the three PWMs;

optionally, two or three ADCs (Analog to Digital Converters) monitoring current on the H-Bridge; and/or optionally, two or three ADCs monitoring back-EMF voltage;

the three-phase brushless DC motor (106), which may include a synchronous-type and/or asynchronous-type permanent magnet motor, such that:

the motor (106) may be in an "out-runner configuration" as described below;

the motor (106) may have a maximum torque output of at least 60 Nm and a maximum speed of at least 300 RPMs;

optionally, with an encoder or other method to measure motor position;

a cable (108) wrapped around the body of the motor (106) such that entire motor (106) rotates, so the body of the motor is being used as a cable spool in one case. Thus, the motor (106) is directly coupled to a cable (108) spool. In one embodiment, the motor (106) is coupled to a cable spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or an actuator (110) such as a handle, a bar, a strap, or other accessory connected directly, indirectly, or via a connector such as a carabiner to the cable (108).

In some embodiments, the controller circuit (102, 1004) is programmed to drive the motor in a direction such that it draws the cable (108) towards the motor (106). The user pulls on the actuator (110) coupled to cable (108) against the direction of pull of the motor (106).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (106).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (110) coupled to a cable (108) coupled to a motor (106). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the cable (108) onto the spool. If the cable (108) is unspooling, it is because a user has overpowered the motor (106). Thus, note a distinction between the direction the motor (106) is pulling, and the direction the motor (106) is actually turning.

If the controller circuit (102, 1004) is set to drive the motor (106) with, for example, a constant torque in the direction that spools the cable, corresponding to the same direction as a weight stack being pulled towards the ground, then this translates to a specific force/tension on the cable (108) and actuator (110). Calling this force "Target Tension", this force may be calculated as a function of torque multiplied by the radius of the spool that the cable (108) is wrapped around, accounting for any additional stages such as gear boxes or belts that may affect the relationship between cable tension and torque. If a user pulls on the actuator (110) with more force than the Target Tension, then that user overcomes the motor (106) and the cable (108) unspools moving towards that user, being the virtual equivalent of the weight stack rising. However, if that user applies less tension than the Target Tension, then the motor (106) overcomes the user and the cable (108) spools onto and moves towards the motor (106), being the virtual equivalent of the weight stack returning.

BLDC Motor. While many motors exist that run in thousands of revolutions per second, an application such as fitness equipment designed for strength training has different requirements and is by comparison a low speed, high torque type application suitable for a BLDC motor.

In one embodiment, a requirement of such a motor (106) is that a cable (108) wrapped around a spool of a given diameter, directly coupled to a motor (106), behaves like a 200 lbs weight stack, with the user pulling the cable at a maximum linear speed of 62 inches per second. A number of motor parameters may be calculated based on the diameter of the spool.

User Requirements

Target Weight 200 lbs

Target Speed 62 inches/sec = 1.5748 meters/sec

Requirements by Spool Size

| | Diameter (inches) | | | | | |
|---|---|---|---|---|---|---|
| | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, 3 Atorque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor speed and/or motor position as with BLDC motors is more appropriate for fitness equipment/strength training systems.

Figure 2:
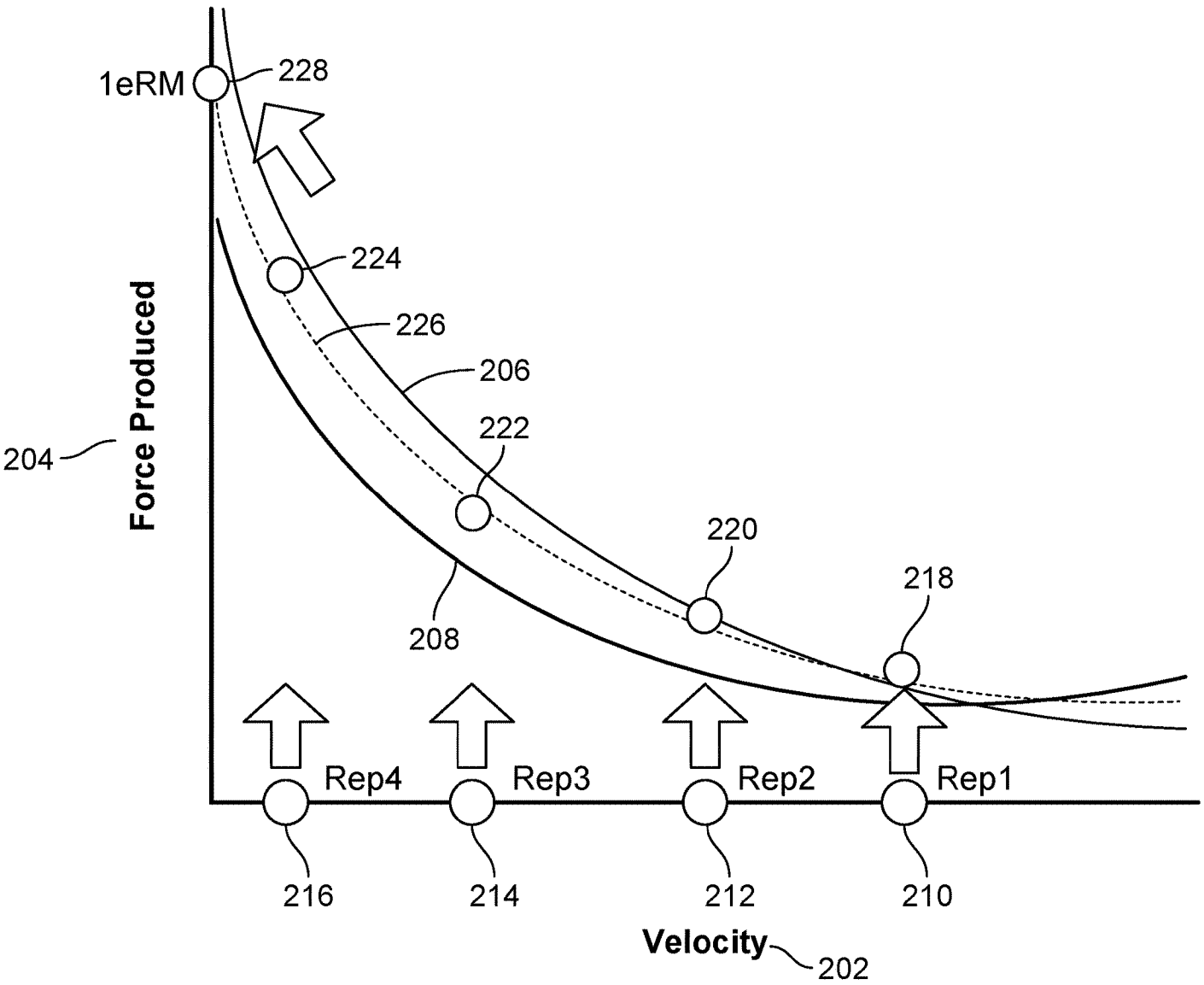
FIG. 2 illustrates an example of strength determination based on isokinetic seed movements.

FIG. 2 illustrates an example of strength determination based on isokinetic seed movements. FIG. 2 is a two-dimensional graph with an x-axis along movement velocity (202) and a y-axis along force produced (204) for that movement. For a given movement, using empirical studies one or more theoretical FVPs (206), (208) may be plotted in general for a typical human being in general, or for a typical human being of a given age, sex, and/or other demographic/physical characteristics.

Using the machine of FIG. 1, the machine prompts and manifests isokinetic seed movements for the user to perform. At least one isokinetic seed movement is needed to determine strength, and practically 3-4 of the same isokinetic seed movement at different speeds may be used to determine strength with greater accuracy. As well, 3-4 different isokinetic seed movements may be used to determine strength for different muscle groups.

From data gathered on these isokinetic seed movements, the maximum weight may be estimated as a 1eRM for the user for movements associated with the isokinetic seed movements performed in a normal, non-isokinetic way, for example smoothly concentric and eccentric. That maximum weight may be used to estimate proper weight for multiple reps, for example 10 reps or 15 reps, of the associated movement in normal/everyday exercise.

In one embodiment, the same data for a few isokinetic seed movements may be used to recommend starting weight for a broad selection of movements that are not necessarily the isokinetic seed movements. In one embodiment, an ongoing recalibration of the strength determination is done without requiring the user to repeat the isokinetic seed movements; instead, the user's performance on each movement is used to update a user's strength level determination.

In the example shown, the machine of FIG. 1 prompts and/or demonstrates to the user how to use the handles and/or attachments (110) to perform an isokinetic seed movement. The machine may manifest three or four isokinetic seed movements for the user to perform. In one embodiment, the machine uses video prompts on a monitor, and for the isokinetic seed movement, the user mimics what they see in the video and are instructed to move the actuator (110) as fast and as powerfully as they possibly can. The machine's resistance dynamically changes to match the user's applied force, while allowing the user to move the resistance at a prescribed constant speed during the concentric phase, establishing for a given speed (210), for example 50 inches/second, a corresponding produced force (218).

The movements are selected to evaluate different muscle groups in the body, and primarily are aimed at lower body, upper body pushing, upper body pulling, and core, and to be easy to perform with proper form and low risk of injury. In one embodiment, the movements used are a seated lat pulldown, a seated overhead press, a bench press, and a neutral grip deadlift. In another embodiment, the movements used exclude bench press or could replace bench press with a movement that focuses on core/abdominal motion.

The machine generates data from these isokinetic seed movements. In one embodiment, at 50 Hz, the machine adjusts the force needed to match the user and maintain a constant prescribed speed. In one embodiment, speed is varied between 20-60 inches/second, decreasing each rep. This time series data is stored during the reps in memory and also to log files that may be stored locally and/or in the cloud with an account associated with the user.

In one embodiment, a second rep of the isokinetic seed movement is performed after an appropriate rest, for example at 45 inches/second (212) a second produced force (220) is established. In one embodiment, a third rep of the isokinetic seed movement is performed after an appropriate rest, for example at 35 inches/second (214) a third produced force (222) is established. In one embodiment, a fourth rep of the isokinetic seed movement is performed after an appropriate rest, for example at 30 inches/second (216) a fourth produced force (224) is established.

With one data point (218) or more (220, 222, 224) data points, a FVP (226) may be estimated for the user. This FVP (226) may intercept the y-axis at point (228), which represents the 1eRM of the user.

Thus with at least one isokinetic seed movement, and practically with 3-4 reps of an isokinetic seed movement at varying speeds, by comparing an amount of force resisted at each given velocity, extrapolation may permit a slope to be drawn and an 1eRM determination is made based on the drawn slope. With the 1eRM, with traditional repetition values associated with specific percentages of a 1eRM, recommendations may be made for different weights. The machine determines user's strength level from at least one and practically with 3-4 isokinetic seed movements on the machine. The force and speed time series data stored during the reps may be used to find the 1eRM the user could perform at each movement. In one embodiment, noise is first removed from sensor measurements. For example, smart average-like values of the speed at which the user acted against the force of resistance are found based at least in part on historical data for a particular machine with its inherent friction/sensor noise and/or for a particular user with their anatomical and physiological past history.

The velocity and force pair determine a one rep maximum that the user can lift, using a traditional relationship/tradeoff between how much force and velocity the human body can generate as shown in FIG. 2, when isokinetic force has been historically observed/studied to determine specific FVP for a movement. The 1eRM is the force at a speed of approximately zero in an FVP. The FVP relationship is based on data collected from many users for each movement, as the relationship varies for each different movement. Using the velocity and force pair the user performed, the 1eRM (228) may be found by following along the FVP (226) to a near-zero velocity. In one embodiment, the user's best result is taken should they try the entire process multiple times.

Once a 1eRM has been calculated, respective rep/weight recommendations may be made based on traditional "rep-percentage" charts which are known in the field to equate a 1eRM to a suggested weight for 10 reps, for example. Practical adaptation includes a suitable attenuation of a recommendation for practical reasons, for example recommending using the rep-percentage charge based on specific rep or percentages may naively recommend a user "do 10 reps at 75% of their 1eRM". This would rate these reps at 9-10 out of 10 on a relative perceived exertion scale and physically the user may not be able to replicate the recommendation across multiple sets. Knowing this, the scale may be attenuated by 10-15% and then those values equated to accommodate physiological fatigue. A final suggestion based on a 1eRM determination may be to "do 10 reps at (60%) of 1eRM", which is still personalized to the user and accounts for fatigue across multiple sets, say 4-6 sets.

In one embodiment, using isokinetic seed movements of seated lat pulldown, a seated overhead press, a bench press, and a neutral grip deadlift, the list of movements with a starting strength determination and rep suggestion may be extrapolated to include those in Table 1 below:

TABLE 1

Extrapolated movements available from seed movement.

| | |
|---|---|
| ½ Kneeling Pallof Press | Tall Kneeling Pallof Press |
| ½ Kneeling Stability Chop | Barbell Deadlift |
| ½ Kneeling Stability Lift | Barbell RDL |
| Bird Dog w/Row | Bulgarian Split Squat |
| Inline Stability Chop | Front Squat |
| Inline Stability Lift | Goblet Curtsey Lunge |
| Iso Split Squat Pallof Press | Goblet Reverse Lunge |
| Iso Split Squat Stability Chop | Goblet Split Squat |
| Iso Split Squat Stability Lift | Goblet Squat |
| Kneeling Cable Crunch | Neutral Grip Deadlift |
| Lateral Bridge w/Row | Pull Through |
| Pillar Bridge w/Row | Resisted Lateral Lunge |
| Pullover Crunch | Resisted Step Up |
| Rotational Chop | Single Arm, Single Leg RDL |
| Rotational Lift | Single Leg RDL |
| Single Leg Pallof Press | Split Squat |
| Single Leg Stability Chop | Sumo Deadlift |
| Single Leg Stability Lift | ½ Kneeling Alternating Overhead Press |
| Standing Pallof Press | ½ Kneeling Chop |
| ½ Kneeling Lift | Neutral Lat Pulldown |
| ½ Kneeling Overhead Press | Seated Lat Pulldown |
| ½ Kneeling Single Arm Overhead Press | Seated Overhead Press |
| ½ Kneeling Single Arm Row | Seated Row |
| Alternating Bench Press | Single Arm Bench Press |
| Alternating Neutral Lat Pulldown | Single Arm Bent Over Row |
| Barbell Bent Over Row | Single Leg Chop |
| Bench Press | Single Leg Standing Chest Press |
| Bent Over Row | Single Leg Standing Lift |
| Chinup | Standing Barbell Overhead Press |
| Front Raise | Standing Face Pull |
| Hammer Curl | Standing Incline Press |
| Inline Chest Press | Standing Overhead Press |
| Inline Chop | Supinated Curl |
| Inline Lift | Tall Kneeling Single Arm Chest Press |
| Iso Split Squat Chest Press | Tall Kneeling Single Arm Lat Pulldown |
| Iso Split Squat Chop | Tricep Extension |
| Iso Split Squat Lift | Tricep Kickback |
| Lateral Raise | Barbell Lying Glute Bridge |
| Upright Row | Barbell RDL |
| X-Pulldown | Barbell Seated Lat Pulldown |
| X-Pulldown w/Tricep Extension | Barbell Seated Overhead Press |
| Y-Pull | Barbell Skull Crusher |
| 90-90 Arm Sweep | Barbell Straight Arm Pulldown |

TABLE 1-continued

| Extrapolated movements available from seed movement. | |
|---|---|
| 90-90 Hip Stretch | Barbell Sumo Deadlift |
| Alternating Bench Press | Bar Move |
| Alternating Bicep Curl | Bench Chest Fly |
| Alternating Neutral Lat Pulldown | Bench Press |
| Assisted Reverse Lunge | Bent Hollow Rocking |
| Assisted Squat | Bent Knee Calf Raise |
| Barbell Bench Press | Bent Over Row |
| Barbell Bent Over Row | Bicep Curl |
| Barbell Bicep Curl | Bird Dog |
| Barbell Chinup | Bird Dog w/Row |
| Barbell Deadlift | Bodyweight Bulgarian Split Squat |
| Barbell Front Raise | Bodyweight Single Leg RDL |
| Barbell Front Squat | Bodyweight Split Squat |
| Barbell Lateral Leg Raise | Goblet Curtsey Lunge |
| Bodyweight Squat | Goblet Reverse Lunge |
| Bretzel Stretch | Goblet Split Squat |
| Bulgarian Split Squat | Goblet Squat |
| Burp | Half Kneeling Alternating Overhead Press |
| Burpee | Half Kneeling Chop |
| Butt Kicker | Half Kneeling Lift |
| Cat-Cow | Half Kneeling Overhead Press |
| Close Grip Barbell Bench Press | Half Kneeling Pallof Press |
| Crunch | Half Kneeling Single Arm Overhead Press |
| Dead Bug | Half Kneeling Single Arm Row |
| Decline Chest Fly | Hammer Curl |
| Elevated Glute Bridge | Hamstring Walkout |
| Elevated Single Leg Glute Bridge | Handle Move |
| External Shoulder Rotation | High Knee |
| Farmer March | Hip Raise |
| Floor Slide | Hollow Body Rocking |
| Foot Elevated Lateral Bridge | Incline Chest Fly |
| Foot Elevated Pushup | Lateral Bridge w/Row |
| Front Raise | Lateral Crawl |
| Incline Pushup | Lateral Lunge |
| Inline Chest Press | Lateral Mountain Climber |
| Inline Chop | Lateral Raise |
| Inline Lift | Leopard Crawl |
| Internal Shoulder Rotation | Lying Bicep Curl |
| Iso Split Squat | Lying Face Curl |
| Iso Split Squat Chop | Lying Hamstring Stretch |
| Iso Split Squat Lift | Marching Glute Bridge |
| Iso Split Squat Pallof Press | Middle Chest Fly |
| Iso Split Squat Single Arm Chest Press | Mountain Climber |
| Iso Squat Hold | Mountain Climber Twist Press |
| Jumping Jack | Neutral Grip Deadlift |
| Jump Lunge | Neutral Lat Pulldown |
| Jump Squat | Neutral Single Arm Straight Arm Pulldown |
| Kneeling Cable Crunch | Overhead Tricep Extension |
| Kneeling Oblique Cable Crunch | Pillar Bridge |
| Lateral Bench Jump | Pillar Bridge w/Row |
| Lateral Bridge | Resisted Leg Lowering |
| Lateral Bridge w/Rotation | Resisted Leg Raise |
| Plank Jack | Resisted Step Up |
| Plank to Toe Tap | Rest |
| Plank w/Reach | Reverse Fly |
| Prone Shoulder Sweep | Reverse Grip Barbell Bicep Curl |
| Pullover Crunch | Reverse Grip Barbell Tricep Extension |
| Pull Through | Reverse Grip Bicep Curl |
| Pushup | Reverse Grip Tricep Extension |
| Pushup to Plank | Reverse Lunge |
| Quad Hip Stretch | Reverse Lunge w/Hop |
| Quad Hip Stretch w/Bench | Reverse Lunge w/Single Arm Row |
| Quadruped Hip Circle | Rope Move |
| Racked Reverse Lunge | Rotational Chop |
| Reach and Rotate Closer | Rotational Lift |
| Reach and Rotate Opener | Rotational Row |
| Resisted Calf Raise | Runners Lunge |
| Resisted Dead Bug | Scapular Pushup |
| Resisted Glute Bridge | Seated Alternating Bicep Curl |
| Resisted Hip Raise | Single Arm Tricep Extension |
| Resisted Lateral Lunge | Single Leg Chop |
| Seated Alternating Overhead Press | Single Leg Dead Bug |
| Seated Bicep Curl | Single Leg Glute Bridge |
| Seated Lat Pulldown | Single Leg Pallof Press |
| Seated Overhead Press | Single Leg RDL |
| Seated Pallof Press | Single Leg Standing Chest Press |
| Seated Row | Single Limb Bird Dog |
| Seated Single Arm Lat Pulldown | Skater Bound |

TABLE 1-continued

| Extrapolated movements available from seed movement. | |
|---|---|
| Seated Single Arm Overhead Press | Skull Crusher |
| Shoulder Shrug | Spiderman Crawl |
| Shoulder Tap Plank | Split Squat |
| Single Arm Bench Press | Sprinter Crunch |
| Single Arm Bent Over Row | Squat Jack |
| Single Arm Deadlift | Squat to Press |
| Single Arm Decline Chest Fly | Squat w/Row |
| Single Arm Incline Chest Fly | Standing Alternating Push-Pull |
| Single Arm Lateral Leg Swing | Standing Barbell Overhead Press |
| Single Arm Resisted Leg Raise | Standing Chest Press |
| Single Arm Single Leg RDL | Tricep Extension |
| Single Arm Squat w/Row | Tricep Kickback |
| Standing Chop | Upright Row |
| Standing Decline Chest Press | V-Up |
| Standing Face Pull | Waiter March |
| Standing Incline Press | W-Hold |
| Standing Lift | Wide Grip Barbell Bench Press |
| Standing Overhead Press | X-Pulldown |
| Standing Pallof Press | X-Pulldown w/Tricep Extension |
| Standing Single Arm Row | Y-Pull |
| Step Up | |
| Straight Arm Pulldown | |
| Suitcase Deadlift | |
| Suitcase March | |
| Suitcase Reverse Lunge | |
| Sumo Squat Stretch | |
| Superhero Iso Hold | |
| Tall Kneeling Pallof Press | |
| Tall Kneeling Single Arm Chest Press | |
| Tall Kneeling Single Arm Lat Pulldown | |

In one embodiment, a goal of the one or more isokinetic seed movements and/or seed movements from a progressive calibration is to determine a user's FVP for a user's muscle group. As described above, with an FVP there are two estimations and/or determinations that may be made. First, the FVP in part determines a 1eRM. Second, recommended starting weights based on percentage 1eRM charts derived through accepted industry norms are available. Again, to be sure a user does not injure themselves on their first set of 10 reps, for example their 15 rep maximum weight is instead computed and recommended, wherein the 15 rep maximum weight is the weight at which a user may do 15 reps but not 16. This 15 rep maximum weight is determined from percentage 1eRM charts traditionally available.

For example, it is determined that a given user has a 1eRM of 50 lb using the machine in FIG. 1 and the technique described above with isokinetic seed movements. According to a traditional percentage 1eRM chart, a 10 rep max may use a weight equal to 75% of the 1eRM, or 37.5 lb. This may be too heavy as the user may only be able to complete a single set of 10 reps. Instead, an adjustment between 10-15% may be made. For example, if a 10% adjustment is made associated with a 15 rep max, then 75%-10%=65% of the 1eRM, which is 32.5 lb. The 10 rep suggestion then would be equivalent to the 15 rep max, producing the suggestion that a user do 32 lbs for 10 reps to start.

In one embodiment, determining a user's FVP for a user's muscle group is related to solving the isokinetic model:

$$F = B(t)\ \exp\ (-a(t)v)$$

wherein F and v are the produced force and movement speed, respectively.

There are at least three sets of information following from a user's FVP:

Strength Calibration—For a given movement and as described herein, given a FVP a ($t_i$) at the range of motion given at time $t_i$ the value of B($t_i$) is solved for, which is the value of F at v=0, or the 1eRM;

Strength Typing—For a given movement, strength typing involves determining an FVP a($t_i$) at the range of motion given at time $t_i$ for a plurality of users. The predetermined FVP, or strength typing, may be established using a pool of users who perform the given movement one or more times and using linear regression and/or other statistical modeling techniques, including, for example, a higher order polynomial-based statistical analysis; and Force-Time Prediction—For a given movement, over a range of motion and/or over time t, both the 1eRM, or B, and LVP, or a, may vary. Force-time prediction analysis determines the corresponding variations over time and plots them as a function of index t. This in turn allows a tracking of translation and/or rotation of the actuator (110) to give coaching and correction to the user on form of an entire movement.

By isolating a force-range of motion curve as in force-time prediction, there are expected tension curves produced throughout ranges of motion. In one embodiment, capture technology including motion capture, force platforms, and inverse kinematics analysis enhances such analysis. In one embodiment, isolating these curves, parsing out sections of the range of motion to determine prime movement, and then implementing an adaptive training protocol to align those curves with expected training needed is performed. This also improves injury prediction.

Suggested Weights Logic Examples. In one embodiment, suggested weights logic and/or processing is implemented in controller circuit (104) and/or filter (102) in FIG. 1, and/or in an external device not shown in FIG. 1 and communicated to controller circuit (104) and/or filter (102). Suggested weights such as that described in U.S. Pat. No. 11,596,837 entitled EXERCISE MACHINE SUGGESTED WEIGHTS filed Mar. 21, 2022, which is incorporated herein by reference for all purposes, may be used with this system.

The following are examples of determining suggested weights for a user's exercise movement.

Example of Suggesting Lower Weight After Being Spotted. An exercise machine that controls motor torque to affect resistance may provide "spotting" to a user.

Consider, for example, a scenario where a user is in the middle of a concentric phase and reaches a point where they cannot complete the range of motion because they are fatigued. This is a common scenario in weight lifting, and may be considered poor form because the user cannot complete the range of motion. However, if the system of FIG. 1 detects this scenario it may "spot" the user, analogous to a human spotter for weight lifting, for example:

1. A user begins by pulling the actuator (110) of FIG. 1 through the range of motion;
2. The user's range of motion is between pre-determined motion thresholds, for example 5% and 80%;
3. The velocity of the cable (108) of FIG. 1 drops to zero, or below some pre-determined velocity threshold close to zero;
4. Even at a low velocity, measured and/or calculated tension applied by the user is found to be above a pre-determined tension threshold for f, the perceived resistance force, based at least in part on torque exerted by motor (106) of FIG. 1;
5. The tension and low velocity persists for a pre-determined period of time, for example 0.5 seconds; and/or
6. The system responds by slowly reducing f, for example linearly over the course of 2 seconds from 100% of starting/current f to a pre-determined force threshold, for example 90% of starting f or 5 lbs. Alternatively, the force is reduced at a fixed absolute rate, such as 20 lbs/sec, regardless of f. As soon as velocity rises above some pre-determined velocity threshold such as 5 cm per second, m stops reducing, and a new function adjusts m through the remainder of the range of motion. Two examples of a new function is a post-spot function or a scaled version of the prior function that the user got stuck on.

In one embodiment, spotted reps are treated the same way that uncompleted reps, or "failed reps", are treated. For example a user may be in an exercise regime that includes 4 sets of 10 reps of 100 lb of a bench press movement, so each set has a "rep count" of 10 reps. In one embodiment, if a user misses this rep count by n reps, the weight is lowered to adjustWeightForRepGoal (100, 10−n+1, 12), such that the amount that the weight decreases by falls in the range of [1, 15%×base_weight] pounds, where the base_weight is 100 lb in this example. The weight is adjusted from a rep goal of 10+n−1 to a rep goal of 12 because someone who failed the rep goal had at most 1 rep in reserve, and users ideally have 2 reps in reserve at the end of a set. Given that in this example, about 10% is typically taken off, if the weight is deemed too heavy to complete the rep count, 10% of the base_weight may be defined as the minimum threshold of being spotted that is counted as a failed rep. The suggested weight may then be 90% of the base_weight for the next set, or 90 lb.

In one embodiment, if somebody is spotted on the last rep of their set, that may be considered simply a healthy way of the user pushing themselves to the limit/burning out, and so it may not be a desirable user experience to lower the weight in that case. The suggested weight for the next set may remain the last base_weight of 100 lb in this example.

In one embodiment, if somebody is spotted in a set at all, that set is not used as proof that a suggested weight should increase over the last weight/base weight. However, if somebody is spotted in a rep that comes after exceeding the "rep goal", then it may be recognized that that person was able to complete the prescribed reps at the prescribed weight, and the weight progression may be treated like a set that was completed properly. A "rep goal" as referred to herein is any goal set by user, coach, and/or system for a number of reps in a given set for a specified movement.

One example of how suggested weights may be adjusted from one set to the next in a workout in the event a user is spotted is a "Spotted Before Meeting the Rep Count Goal" protocol:

1. If a user is spotted at least 10% of base weight on a rep before the last rep of the rep count goal, for example, with a rep count goal of 10, spotted 10% of base weight on rep 9 or earlier, then reduce the weight to adjustWeightForRepGoal (100, 10−n+1, 12), where n is the number of missed reps, such that the amount that the weight decreases by falls in the range of [1, 15%× base_weight] pounds;
2. If a user is spotted at least 10% of the base weight for the first time in the set on the last rep of the rep count goal, for example with a rep count goal of 10, spotted 10% of the base weight on rep 10, spotted less than 10% of base weight on reps 1-9, then do not lower the suggested weight for the next set and/or treat the set similarly to how other sets that are spotted are treated; and/or If a user's maximum spotted weight of a set before meeting 100% of the rep count goal is less than 10% of base weight, then do not lower the suggested weight for the next set and/or treat the set similarly to how other sets that are spotted are treated.

One example of how suggested weights may be adjusted from one set to the next in a workout in the event a user is spotted is a "Spotted After Meeting The Rep Count Goal" protocol:

If a user is spotted after meeting the rep count goal, for example with a rep count goal of 10, spotted for the first time in the set on rep 11 or later, then treat the set similarly to as how a set where the user successfully met the rep count goal without being spotted is treated. For example, with a rep goal of 10, if user is spotted on the 11th rep, treat the set as though they did 10 unspotted reps.

Example of Suggesting Lower Weight After Long Breaks. If a user has been inactive on a strength trainer/exercise machine for a long time—for example at least three weeks, or any other period of time as appropriate—a suggested weight may be a lower weight than the last weight exercised before the long break. In one embodiment, a suggested weight may be a weight that is lowered at a higher rate than at which a suggested weight would be lower otherwise. For example, if during normal workout sessions a suggested weight was 10% lower for a failed seventh rep and 5% lower for a failed eighth rep, after a long break a similar suggested weight may be 20% lower for a failed seventh rep and 15% lower for a failed eighth rep.

Typically a user finds a home digital strength trainer one of the most convenient means of strength training, so if the exercise machine is being unused, it is unlikely that they are instead going to the gym. In one embodiment, the suggested weight for a movement is lowered if a user has not worked the muscle groups associated with that movement in at least the last three weeks or any other time period as appropriate.

In one embodiment, to start the "primary muscle group" and "secondary muscle group" of a movement are focused on, and it is determined whether either one has been worked as either a primary mover or secondary mover in at least the last three weeks. For example if a user is doing a bench press and has not worked on chest muscle groups or arm muscle groups for more than three weeks, a suggested weight may be a drop of 15% from the last bench press. In one embodiment, care is taken to not drop the weight too far, as weight progressions may not ramp the user back up to previous strength quickly enough.

As referred to herein, a "primary muscle group" is one with the highest muscle utilization value (0-100 scale) for a given movement. These are the muscles targeted by the movement and used intensely. One example is for the movement Neutral Grip Deadlift, which has Hamstrings as its primary muscle group. Another example is that of the movement Bench Press, which has a primary muscle group of Chest.

As referred to herein, a "secondary muscle group" has the second highest muscle utilization for a given movement. Secondary muscle groups are intensely used, but usually not the limiting factor in how much weight a user can lift. One example is for the movement Neutral Grip Deadlift, which has Glutes as a secondary muscle group. Another example is that of the movement Bench Press, which has Triceps as a secondary muscle group.

In one embodiment, a muscle group protocol for a user performing a move whose primary muscle group is called X, and secondary muscle group is called Y:

- If muscle X has not been worked as a primary or secondary muscle in at least the last three weeks, and neither has muscle Y, then the suggested weight is a drop of the last exercised weight of that movement by 15%; and/or
- If muscle X or muscle Y has been worked either as a primary muscle or secondary muscle in at least the last 3 weeks, then the suggested weight is the same as the last exercised weight of that movement.

A triceps-based example of determining suggested weights based on muscle groups includes:

- If a user is starting a triceps extension movement, and has done triceps-focused/triceps-primary movements such as triceps kickbacks in the past three weeks, then the suggested weight for the current triceps extension movement may be the same base weight as the last triceps extension movement, even if that took place longer than three weeks ago.
- If a user is starting a triceps extension movement, and has not done any triceps-focused/triceps-primary movements such as triceps kickbacks in a month, but has done bench press movements which are triceps-secondary within the past 3 weeks, then the suggested weight for the current triceps extension movement may be the same base weight as the last triceps extension movement, even if that took place longer than three weeks ago.
- If a user is starting a triceps extension movement, and has not done any triceps-focused/triceps-primary movements such as triceps kickbacks in the past 3 weeks, nor any triceps-secondary movements within the past 3 weeks, then the suggested weight for the current triceps extension movement may be to drop the next weight to max (1, 15%×base_weight) 1b.

In one embodiment, key performance indicators ("KPI") are tracked and/or used to contribute to determining suggested weights. For example, detecting a decrease in a KPI representing the number of times/amount by which a user manually lowers the weight for one or more movements after they return to the exercise machine from a long break may itself trigger a suggested weight of a lower amount for all other movements.

In one embodiment, features are used to contribute to determining suggested weights. For example, secondary muscle groups may be tracked more closely and/or tertiary muscle groups may be used. For example, different suggested weight "trajectories" may be used, such as aggressively lowering a suggested weight for first few movements to reacclimate the user with the movement, and then aggressively ramp up suggested weights to where they were before after it is detected they are reacclimatized. For example, different suggested weight reductions may be used for different movement families, rather than using a static weight reduction such as 10% or 15%.

Example of Increasing Suggested Weight After Rep Goal is Exceeded. If a user has exceeded their rep goal by a large amount, they are far more likely to increase the weight on the next set than they otherwise would. In one embodiment, when a user exceeds the rep goal, instead of just increasing the weight by one to two pounds, the weight is adjusted for the rep count they just completed. For example, if they completed 15 reps at 50 pounds when the rep count goal was 10, the next set's suggested weight is set as the "10-rep equivalent" of doing 50 pounds for 15 reps.

Figure 3A:
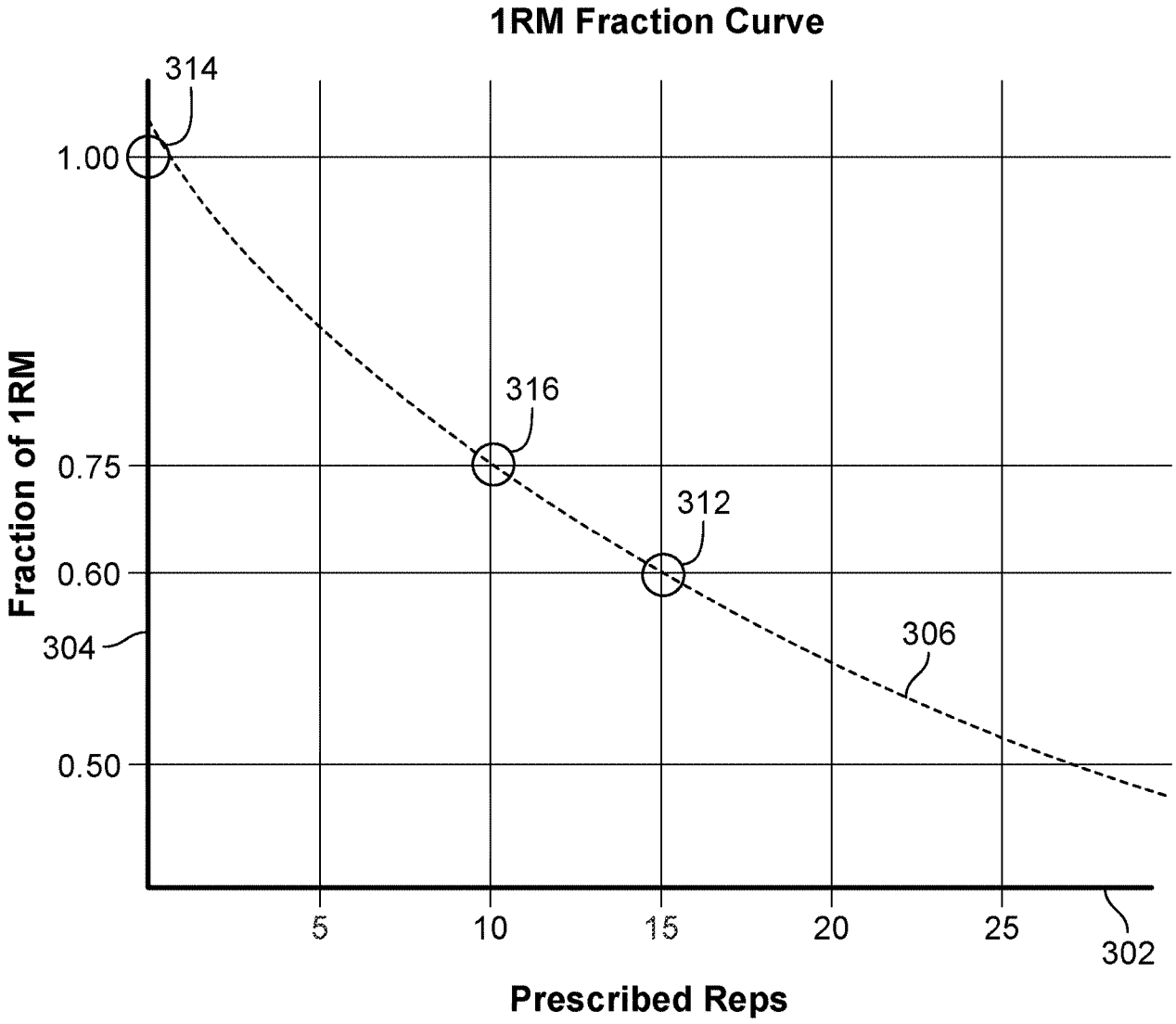
FIG. 3A illustrates an example of rep equivalent determination based on an 1RM fraction curve.

FIG. 3A illustrates an example of rep equivalent determination based on an 1RM fraction curve. FIG. 3A is a two-dimensional graph with an x-axis along prescribed reps (302) and a y-axis along a fraction of one-rep maximum (1RM) (304) for a given movement. For a given movement, using empirical studies one or more curves (306) may be plotted in general for a typical human being in general, or for a typical human being of a given age, sex, and/or other demographic/physical characteristics.

As referred to herein, an "X-rep equivalent" is determined at least in part by finding the 1RM of 50 pounds for 15 reps from data point (312) on the curve, which shows that 15 reps of 50 lb are equivalent to an 1RM of 50 lb+60%=83.3 lb (314). Converting the 1RM of 83.3 lb to a 10-rep equivalent weight may be made in part by following the curve to point (316), or 83.3 lb×75%=62.51 lb, a suggested weight increase of 12.5 lb. In one embodiment, the set-by-set weight increases are limited to a maximum, for example 10 pounds, to reduce user safety issues with high spikes of increased weight.

In one embodiment, when an empirical curve is unavailable an analytical curve is used, for example one formula for suggesting weight after a rep count goal is exceeded is:

$$suggestedWeight = previousWeight \times \frac{getFrac1RM(repCountGoal)}{getFrac1RM(repCount)}$$

where suggestedWeight is the suggested weight for a movement, previousWeight is the previous weight lifted for the movement, repCount is the previous exceeded rep count for the movement, and repCountGoal is the upcoming rep count goal for the movement, and $$getFrac1RM(x) = 70\% \times e^{-K(x-1)} + 30\%$$

$$K = -0.048609$$

under the constraint $$\leq suggestedWeight - previousWeight \leq 10$$

This determination for suggestedWeight, referred to herein as an "adjustWeightForRepCountGoal" determination, may also be used to scale weights to sets with different rep count goals, and/or to increase/decrease weights.

Two-sided movements—those that have a "left side" and "right side" such as bicep curls—are limited by the weaker side. In one embodiment, if the rep count goal is 10 and the user did 12 reps on one side and 15 on the other, the set is treated as though they did the lower number, 12 reps, on both sides. In one embodiment, if the user exceeds the rep goal on one side but does not exceed the rep goal on another side, the set is treated as though they did not exceed the rep goal.

In one embodiment, key performance indicators ("KPI") are tracked and/or used to contribute to determining suggested weights. For example, detecting a decrease in a KPI representing the number of times/amount by which people manually increase the weight after they exceed the rep goal by a large amount for a given movement may trigger a suggested weight of a greater amount for all other movements.

Suggesting Starting Weights. Users may perform strength determination/calibration as described above to suggest a starting weight. In one embodiment, users perform one set of four moves with three reps in the baseline and/or isokinetic mode to determine a suggested starting weight. In one embodiment, if a user does not do the baseline, a default of a minimal weight is used for a user to improve safety, for example a minimal weight of five pounds.

In one embodiment, an improved feature for determining suggested weights based on related movements is used. The improvement is to use additional information from related movements to suggest a starting weight to improve user safety and efficiency of weight training for a user. As described herein, movements with "similar muscle utilization" are movements that have cosine similarity of 0.8 and above when comparing muscle utilization vectors.

Every movement has a corresponding muscle utilization vector, which is a vector composed of each muscle's utilization (0-100 value) as an element, [<calf muscle utilization>, <quadricep muscle utilization>, <hamstring muscle utilization>, <glute muscle utilization>, <back muscle utilization>, <abdominal muscle utilization>, <obliques muscle utilization>, <chest muscle utilization>, <shoulder muscle utilization>, <bicep muscle utilization>, <tricep muscle utilization>, <forearm muscle utilization>]. Cosine similarity is a mathematical function that takes as input two vectors of any and/or equal length, and returns the cosine of the angle between them. For example, the Bench Press movement may have a muscle utilization vector of [0, 0, 0, 0, 0, 3, 1, 95, 25, 0, 30, 0] and the Pushup may have a muscle utilization vector of [0, 0, 0, 0, 0, 5, 0, 60, 10, 0, 25, 0]. Notice the largest muscle utilization in each vector belongs to the chest muscle. The cosine similarity of these two vectors is 0.991.

In the event this feature is used:

- if the user has done a threshold number of movements (for example, four movements) with similar muscle utilization, then the 1RM of this current movement is considered to be 90%×median of the best normalized IRM of each movement with similar muscle utilization and a suggested starting weight for a given prescribed rep set is based on the 1RM of the current movement using a curve and process similar to that described above in associated with FIG. 3A. 1RMs for each movement are "normalized", as referred to herein, using population distributions of weights used for each move, for example, using the percentile within each movement's weight distribution;
- else the starting suggested weights for the movement is based on an estimate from the baseline set of moves as described herein for strength determination/calibration.

Suggested Weights for Rep-Based Sets. Rep-based sets as described herein are traditional strength training sets where a user performs a number of sets of a number of prescribed reps. An example might be to do four sets of 10 reps of bench press.

Related Movements. In one embodiment, the improved feature for determining suggested weights based on related movements is used. The improvement is to use additional information from related movements to suggest a weight for a rep-based set to improve user safety and efficiency of weight training for a user. In the event this feature is used:

- if a current movement has not been performed before and the user has done a threshold number of sets of movements (for example, four sets) with similar muscle utilization, then the 1RM of this current movement is considered to be 90%×median of the normalized 1RMs of each set of a movement with similar muscle utilization, where the 1RM is normalized in the manner described above, and a suggested starting weight for a given prescribed rep set is based on the 1RM of the current movement using a curve and process similar to that described above in associated with FIG. 3A;
- else if the current movement has not been performed in a threshold number of months (for example, four months) preceding a second threshold number of most recent sets of movements with similar muscle utilization (for example, four most recent sets), then the 1RM of this current movement is considered to be 90%× median of the normalized 1RM of each set of a movement with similar muscle utilization, where the 1RM is normalized in the manner described above, and a suggested starting weight for a given prescribed rep set is based on the 1RM of the current movement using a curve and process similar to that described above in associated with FIG. 3A;
- else if the current movement has been performed within a last threshold number of months (for example, the last five months), then the suggested weight for the rep-based set is at most a threshold percentage (for example, 10%) of what the current movement was last performed at. For example, if the current movement was last performed at 100 lb, the current movement may now be performed at a suggested weight at 90 lb.

Dynamic Weight Modeling. In one embodiment, the improved feature for determining suggested weights based on dynamic weight modeling is used. Dynamic weight modeling as described herein includes any weight modeling that may change over the movement, for example eccentric weight models that increase weight for a user during the eccentric phase of exercise, chains weight models that model lifting a chain off the ground, with variable resistance during the range of the movement as more of the chain is lifted off the ground, and/or a "smart flex" weight model that matches a user's strength at every point in the range of motion in the movement, as described in U.S. patent application Ser. No. 17/323,277 entitled DYNAMIC STRENGTH LOADING PER MOVEMENT filed May 18, 2021 which is incorporated herein by reference for all purposes.

The improvement is to use previous information from dynamic weight modeling performance to suggest a weight for a rep-based set to improve user safety and efficiency of weight training for a user. In the event this feature is used, the suggested weight including dynamic weight models when checking to see if a user has completed consecutive sets without weight increase and/or what weight to suggest for the next set may use an example formula:

$$suggestedWeight = baseWeight + 25\%\ eccWeight\frac{repGoal - 1}{repGoal} + 35\%\ (smartFlexWeight + chainsWeight)\frac{repGoal - 2}{repGoal}$$

where suggestedWeight is the suggested weight, baseWeight is the current weight for a movement, eccWeight is the additional eccentric phase weight for the movement, smartFlexWeight is the additional maximum smart flex weight for the movement, chainsWeight is the additional maximum chains weight for the movement, and repGoal is the rep goal for the movement.

For example, if a first set for a given movement uses a dynamic weight model at 10 lb resistance plus 40% eccentric weight with a rep goal of 10, and the second set has no dynamic weight modeling with the same rep goal, using the above formula the second set suggested weight is 10 lb+25%×4 lb×0.9=10.9 lb which may be rounded to 11 lb.

Weight Percentage. As referred to herein, 'weight percentage' is a fraction of the weight a user is believed to be capable of a given movement and/or set with the given movement. One relationship that may be used is:

$$weightPercentage = \frac{\text{reduced_baseWeight}}{normalWeight}\text{ in }\%$$

where weightPercentage is the weight percentage, the reduced_BaseWeight is the resistance used in a current set of a current movement, and normalWeight is the user's normal suggested weight for the current movement. Both of these weights already contain all of the other adjustments, including adjustments for the rep goal.

Using weight percentage to determine suggested weights is disclosed. In one embodiment, the weight percentage of an upcoming set is used to determine which recent sets are looked at to determine a suggested weight. The weight percentage may be used as an indication of workout intensity for a set. For example, 100% weight percentage is indicative of a challenging set. This may be a default for most sets. In some cases, the weight percentage may be lower for less challenging sets. The weight percentage may also be over 100% for an extremely challenging set, even if there is a high likelihood that the user will be unable to complete the set. The weight percentage may be used as an adjustment factor to adjust the intensity or the level of challenge for a set.

In one embodiment, sets where the weight percentage is below a threshold, for example 85%, do not impact a suggested weight for a future set. For example, this may indicate a warmup set, for example at a weight percentage of 60%, which is not indicative of a user's performance and/or ability—put another way, very easy sets are not necessarily a reliable predictor of very heavy sets.

In one embodiment, if an upcoming set's weight percentage is more than a specific threshold, for example 85%, only other sets which were done at a weight percentage over a particular threshold, for example 85%, are used to determine a suggested weight. In one embodiment, if an upcoming set's weight percentage is less than a given threshold, for example 85%, all sets regardless of weight percentage are used to determine a suggested weight.

Increases in Suggested Weights. In one embodiment, suggested weight for a current set of a movement is increased by a determined threshold step in the event that there is a subset of consecutive sets where the user met their rep goal over a superset of sets of the movement. In one embodiment, increases in suggested weight do not occur for user-safety sensitive movements. For example, one technique is:

- If the user meets their rep goals for two consecutive sets of a movement or the user meets their rep goals for five consecutive sets in the event they have completed 40 sets for the movement;
- And all of the following conditions are met:
  - 1RM in the previous set for the movement is less than or equal to 1RM in the set before the previous set for the movement;
  - the user did not decrease the weight for this movement within this workout;
  - a spotter and/or spotter mechanism did not reduce the weight in the previous consecutive sets. Reps that were spotted after the rep count goal may be ignored;
  - there are more than two reps in reserve ("RIR") at the end of the set; and
  - the movement is not an Internal Shoulder Rotation or an External Shoulder Rotation, or any other movement indicated as user-safety sensitive;
- Then the suggested weight for the movement is increased by whichever is larger: an increase of one pound or an increase of 2.5% over the current base weight.

As referred to herein, RIR is an estimate of how many reps a user may have in reserve before reaching their limit/capacity. Thus if a particular user can only do ten theoretical reps, and they are currently on their eighth rep, their RIR is two.

In one embodiment, a technique for increasing suggested weight is based on exceeding the rep goal. For example, one technique is:

- If a user has exceeded their rep goal on a previous set of a movement and a spotter and/or spotter mechanism did not reduce weight in the previous set of the movement;
- Then the suggested weight is increased from the previous set of the movement by a minimum of 1 lb and maximum of 10 lb, as a function of previous set weight, previous set reps completed, and upcoming set rep goal, as described above using the adjustWeightForRepCountGoal determination.

Decreases in Suggested Weights. In one embodiment, a suggested weight for a current set for a movement may be decreased based at least in part on a rep goal not being met. For example, one technique is:

If at least one of the following conditions is true:

a user did not meet their rep goal in a previous set of a movement;

a spotter and/or spotter mechanism reduced a user's weight by at least 10% on a rep except the last rep of the set's rep count goal for the movement; or Then the suggested weight is a weight decreased from the previous set in the same workout by whichever is larger: a decrease of 15% of the current base weight, or a function of weight, reps, and rep goal, for example a function adjustWeightForRepGoal (weight, reps+1, repGoal+2).

But, if a user was spotted or failed the rep goal on the last set of the movement in a workout then the weight for the beginning of the next workout is not reduced.

In one embodiment, if a user has not worked out either the primary or secondary muscle groups associated with a movement in the past time threshold, for example 3 weeks, then the suggested weight is a weight decreased from the previous set in the movement by whichever is larger: a decrease of one pound from the current base weight, or a decrease of 15% of the current base weight.

In one embodiment, if in a user's previous set of a movement in a workout, the user manually increased the weight on their own but failed the rep goal, the next time the user does that movement, they are given the previous set's suggested weight. In one embodiment, they are given a previous set's base weight. In one embodiment, they are given a previous set's base weight adjusted for rep goal. The weight may be adjusted for rep goal computationally using $$suggestedWeight = previousWeight \times \frac{getFrac1RM(currentRepGoal)}{getFrac1RM(previousRepGoal)}$$

In one embodiment, a user safety analysis is made and determining a suggested weight comprises decreasing weight to provide user safety.

Two Sided Movements. Two sided movements that have a left-side and right-side, may have specific techniques to accommodate their nature. For example, one technique is:

If either side was below the rep goal, then decrease suggested weight from previous set by the greater of a pound or 10% of the base weight for the movement;

If the following four conditions are met:

the user exceeded their rep goal on both sides;

the user did not reduce the weight for this movement in this workout; and a spotter and/or spotter mechanism did not reduce the weight by at least 10% on a rep, excepting the last rep, of the set's rep count goal for either side; and there are more than two reps in reserve ("RIR") at the end of each side;

Then increase suggested weight from previous set for the movement by the greater of a pound or 2.5% of the base weight for the movement;

Else suggest the previous set's weight, for example a second side's weight, optionally adjusted for rep goal.

Suggested Weights for Duration-Based Sets. Duration-based sets as described herein are sets where a user is encouraged to perform as many reps as possible within a given duration. One example of a duration-based set is a traditional high-intensity interval training (HIIT) workout. An example might be to do four sets of 30 seconds of bench press. Using a duration-based rep goal equivalent to determine suggested weights for a duration-based set is disclosed.

In one embodiment, for a linear workout, wherein a 'linear workout' is a workout where the coach is doing the workout along with the user at the same pace and is speaking in the video, rather than audio disconnected from the video as with a voiceover for duration-based sets, the first set of a movement uses the suggested weights from previous guided personal training, custom, and/or freelift workouts.

In one embodiment, HIIT workouts have weight percentage reduced to a threshold, for example 90%, as the weight percentage is an indication of workout intensity for a set. The system may stop providing high volume suggested weight decreases, or any suggested weight decreases.

In one embodiment, if the workout with duration-based sets is of the HIIT type, the suggested weight is calculated assuming a rep goal based at least in part on dividing the prescribed duration by a threshold, for example, a rep goal of prescribedDuration/2. Thus for a 30 second set, an assumption is made that the user will do 15 reps in 30 seconds.

In one embodiment, if the workout with duration-based sets is purely strength training, the suggested weight is calculated assuming a rep goal based at least in part on dividing the prescribed duration by a different threshold, for example a rep goal of prescribedDuration/3.5. Thus, for a 30 second set, a rep goal for the user is computed as ~9 reps in 30 seconds.

Suggested weight increases for duration-based sets may happen if a user exceeds the rep goal. For example, for HIIT type workouts, if a user exceeds their rep goal, the suggested weight for the next set may be set to adjustWeightForRepGoal (weight, repGoal, repCount). For example, for strength training type duration-based workouts, if a user exceeds the rep goal by a threshold percentage, for example 30%, the suggested weight for the next set may be set to adjustWeightForRepGoal (weight, 130%×repGoal, repCount).

Suggested weights for High Volume workouts. High volume workouts as described herein are workouts with total relative muscle volume above a certain threshold for each muscle group. In these high volume workouts, moves with the exceeded muscle group as the primary muscle will have weight percentage reduced linearly depending on the exceeded amount up to 90%. This weight percentage is applied at the beginning of the workout. This feature is devised to preemptively reduce weights for long workouts so users are able to complete the workout without failing midway. If there are multiple muscle groups that are high volume, and a move consists of more than one primary muscle that is high volume, the minimum weight percentage is taken. Relative muscle volume of a set is determined by:

$$\text{relative muscle volume} = num.\ reps \times \frac{\text{weight}}{1RM} \times \text{muscle utilization} = num.\ reps \times \text{1RM_fraction} \times \text{muscle utilization}$$

Figure 3B:
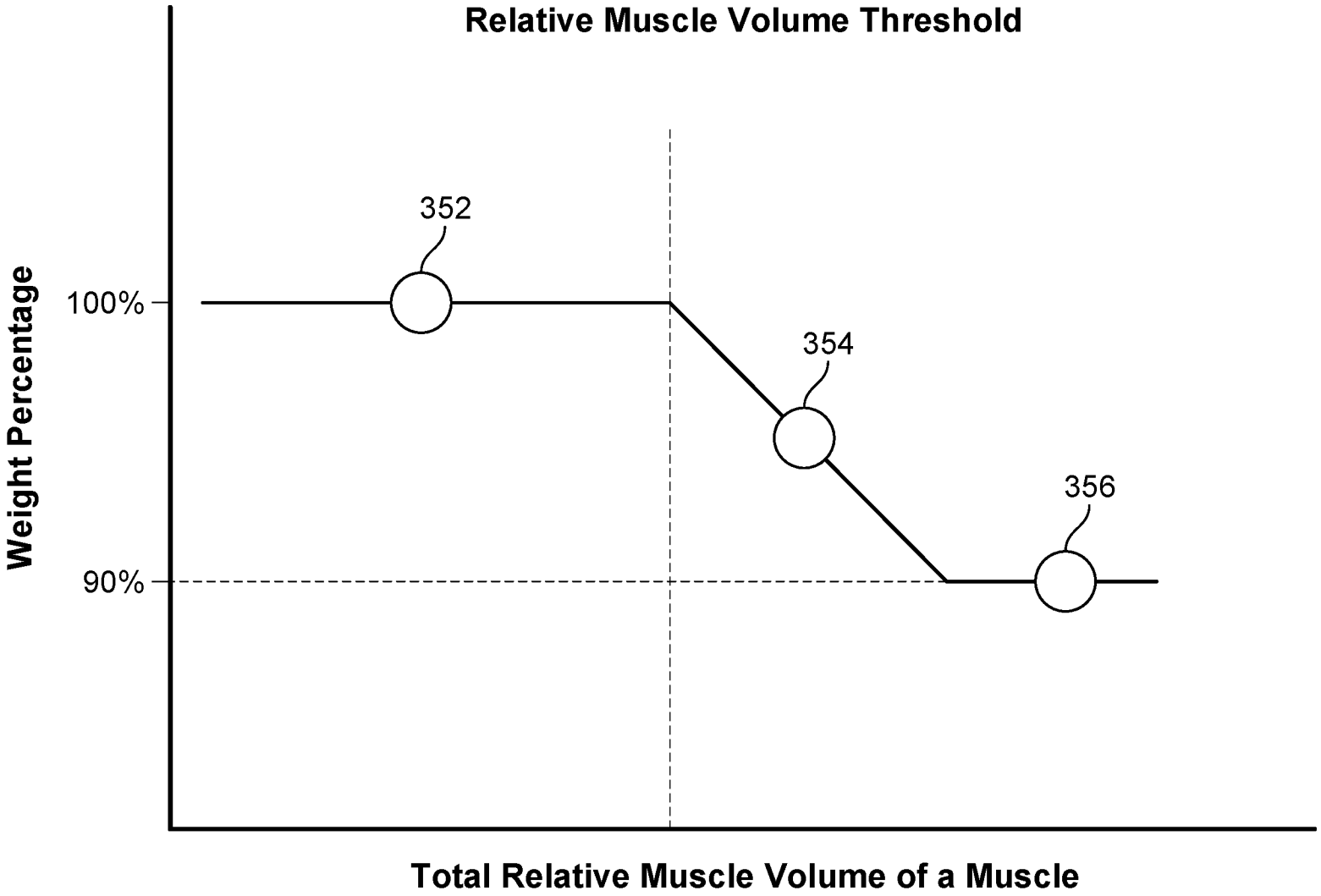
FIG. 3B illustrates one embodiment of linear weight percentage reduction for a particular muscle in a workout.

FIG. 3B illustrates one embodiment of linear weight percentage reduction for a particular muscle in a workout. There is no weight percentage reduction if the total relative muscle volume for a muscle is below the threshold (352). If the threshold is exceeded, reduction is applied linearly (354). When the minimum weight percentage is reached, for example 90%, weight percentage is not reduced further (356).

Figure 4:
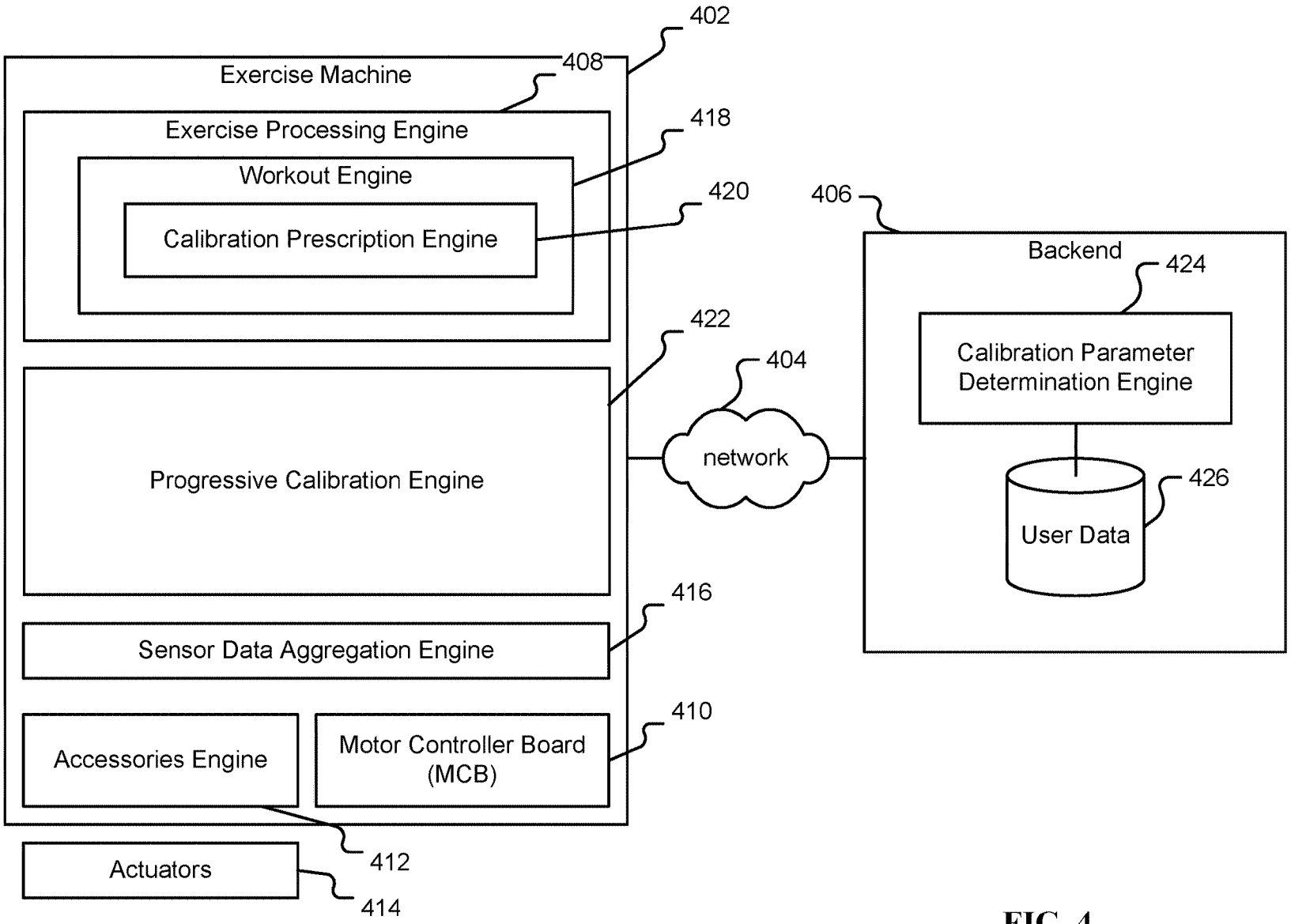
FIG. 4 illustrates an embodiment of a system for progressive strength calibration.

FIG. 4 illustrates an embodiment of a system for progressive strength calibration. In this example, exercise machine (402) is an alternate view of the exercise machine embodiments shown in FIG. 1. Progressive strength calibration such as that described in U.S. Patent Publication No. 2021/0402259 A1 entitled PROGRESSIVE STRENGTH BASELINE filed Jun. 23, 2021, is incorporated herein by reference for all purposes.

As shown in this example, exercise machine (402) also communicates, over a network (404) such as the Internet, with backend (406).

In this example, exercise machine (402) includes exercise processing engine (408), motor controller board (410) (an example of motor controller (104) in FIG. 1), accessories engine (412), and actuators (414). In one embodiment, these elements are compute/sensor nodes that form a computation architecture/stack in which sensor measurements are taken, and computations on such sensor measurements are made, at various levels.

In this example, at the bottom level/layer of the stack are actuators/accessories (414), examples of which include handles, bar controllers, smart mats, etc. In one embodiment, the sensors at the level of actuators (414) include IMUs, buttons, force sensors, etc.

At the next level of the computation architecture is accessories engine (412). Accessories engine (412) is configured to aggregate sensor data from the actuators. As one example, accessories engine (412) is implemented using the BLE (Bluetooth Low Energy) Central plugin, which communicates with accessories (e.g., via BLE, USB, RF, etc.). In one embodiment, the accessories engine is configured to determine the positions of accessories/actuators in physical space.

At the next level of the computation stack is motor controller board (MCB) (410). MCB (410) is another example of a computation node/layer in the computation architecture. In this example, the motor controller board collects data such as cable position and speed, motor position and speed, cable tension, scalable stack information (e.g., health of the motor, board, processor/memory of the board, and communication), etc. As one example, the motor controller board (MCB) is configured to receive encoder messages and determine right and left cable lengths. In one embodiment, the MCB provides such sensor readings to sensor data aggregation engine (416). The information may be sent via a communication bus such as a USB (Universal Serial Bus). The information may be sent periodically (e.g., at a frequency of 50 Hz).

In the next layer of the computation architecture is exercise processing engine (408). In one embodiment, exercise processing engine (408) is a portion of an application running on a computing device included or otherwise associated with the exercise machine. As one example, the application is an Android application running on a computing device such as an Android tablet or computing device embedded in the exercise machine.

In this example, exercise processing engine (408) includes workout engine (418). In one embodiment, the cloud entity/backend (406) includes a system for creating workouts. This includes stitching together clips of video and audio in an automated manner. The outline or plan for the workout is referred to herein as a "timeline," which indicates what events (e.g., exercise movements, transitions between movements, audiovisual cues, etc.) should happen at what times. In one embodiment, flexibility is built in depending on the user's actions. In one embodiment, workouts generated by the backend are downloaded by the client exercise machine (exercise machine (402)), where workout engine (418) is configured to play the workout according to the timeline. In other embodiments, workout engine (418) is configured to generate timelines.

In this example, workout engine (418) further includes calibration prescription engine (420). Calibration prescription engine (420) is configured to determine whether to prescribe calibration for a movement (e.g., in the timeline). Examples of conditions for determining whether to prescribe calibration include initiation, inactivity, injury, etc. If the calibration prescription engine determines that calibration should be prescribed for a given movement, the workout engine, for example, modifies the timeline to indicate that, for a given set of the movement, progressive calibration mode is turned on (e.g., via a flag). This indicates to progressive calibration engine (422) that progressive calibration is to be performed for the set. As may be described in further detail below, the progressive calibration engine is configured to, during the calibration set, control the motor such that the weight applied to the user is progressively adjusted. In one embodiment, calibration parameters (e.g., movement parameters and calibration algorithm parameters) are passed to progressive calibration engine (422). Further details regarding calibration parameters may be described below. In one embodiment, the calibration parameters are received from backend (406). In this example, the calibration parameters are determined by calibration parameter determination engine (424). In one embodiment, the calibration parameters are determined using global user data (e.g., user data stored in user data store (426)). Further details regarding selection or determination of calibration parameters may be described below.

Progressive calibration engine (422) is configured to execute progressive strength calibration. In one embodiment, this includes controlling the motor (e.g., using firmware to control MCB (410)) to implement progressive strength calibration. The progressive strength calibration is performed using calibration parameters. Further details regarding progressive strength calibration are described below. As may be described in further detail below, the progressive strength calibration is performed in part by processing and analyzing sensor data (e.g., from accessories and the MCB), as well as user data stored in user data store (426) (e.g., user profiles, measurements, goals, suggested weights, etc.), workout data (e.g., current move, load profile for the current move, etc.), camera and microphone information, etc.

The next layer of the computation architecture includes backend (406). In this example, the backend compute node includes calibration parameter determination engine (424) and user data store (426). User data store (426) includes information aggregated from multiple users of multiple exercise machines, and includes, for example, population statistics for all or subsets of users. The user data store also includes data specific to individual users. As may be described in further detail below, the data in user data store (426) is used to determine personalized calibration parameters. In one embodiment, backend (406) is implemented on off-premises and/or cloud instances such as Amazon EC2 instances.

As shown in this example, data and data streams, such as sensors and user information/preferences, are distributed throughout the system/computation architecture.

In one embodiment, progressive strength calibration is performed based on data collected from multiple sensors. Data may be fused, correlated, or analyzed at any compute node in a process referred to herein as "sensor fusion." The sensor data may also be passed through or pushed downwards to be operated on by various compute nodes in the computation stack.

As one example, suppose that the actuators (414) being used are two handles. The measurements taken from sensors (e.g., IMUs) in the two handles are passed to accessories engine (412) of the exercise machine, which aggregates, for example, sensor readings from all actuators. The actuator sensor data is then passed to exercise processing engine (408).

Sensor information collected by MCB (410) is also passed to sensor data aggregation engine (416). As shown in this example, sensor data aggregation engine (416) is configured to collect and aggregate the various and disparate sensor information (e.g., IMU sensor data, cable/motor/tension sensor data, etc.). Progressive calibration engine (422) is then configured to perform progressive strength calibration using the combined sensor data.

In one embodiment, data, such as workout data (e.g., from MCB (410)) and accessory data (e.g., smart bench data), is provided to backend (406).

In one embodiment, progressive strength calibration is calculated at any of the above compute nodes in the computation architecture. In one embodiment, the algorithms and logic to perform the aforementioned progressive strength calibration are distributed across the entire stack with interfaces between each to obtain optimal performance and accuracy, along with low latency. For example, tasks that require latency that is lower than is possible based on communication between layers are done at lower levels. When latency can be higher or when data is taken in aggregate (e.g., across an entire workout), algorithms are run at higher levels where more computational power and contextual data is available.

Progressive Strength Calibration. Progressive strength calibration engine (422) is configured to determine the right weight for a user over the course of a set of repetitions of a movement (e.g., a weight that is challenging for the user, but may not push the user to failure by the end of a set). As may be described in further detail below, in one embodiment, the progressive strength calibration continuously increases the weight until the user's speed reduces, and then hones in with smaller increases and decreases.

Initialization of Calibration Mode. Determining whether to Prescribe Calibration Mode. In one embodiment, the calibration mode includes prescribing progressive strength calibration for a set of a movement during a workout routine.

Prescription of the calibration set (e.g., by calibration prescription engine (420)) may be triggered based on a variety of conditions. Examples of such conditions include:

- New user;
- Time away from the exercise machine: For example, inactivity, where the exercise machine maintains a record of how much time has elapsed since the user has used the exercise machine or otherwise performed exercise. In one embodiment, if the inactive period meets or exceeds a threshold, the progressive calibration mode is triggered or prescribed;
- Change in user's ability: For example, due to injury. As the strength calibration mode described herein progressively increases resistance, rather than providing a test to failure or a direct one-rep maximum test that requires maximum effort from the user, the calibration mode described herein is gentle enough to estimate a user's strength even when they are recovering or returning from injury. Another example of a change in user's ability is post-natal, after giving birth; and/or
- Discrepancies between related movements: In one embodiment, recalibration for movements is performed if it is determined there is a discrepancy (e.g., that exceeds a threshold) in the resistance applied for two related movements.

One example is two related moves—bench press with a bar, and bench press with handles. Suppose that in this example, the normalized (by population average weights, for example) suggested weight for the bench press with the bar is substantially higher (e.g., more than a threshold amount of weight) than the normalized weight for the related bench press with handles. In response to detecting the discrepancy in weights suggested or applied for the two related exercise movements, recalibration is performed for one or both of the movements (because it is likely that the prescribed weight for at least one of the moves is incorrect, and thus confidence that the correct weight is being provided is lower).

The information used to determine whether to perform calibration may be provided in a variety of ways, such as explicit user input and/or derived from information maintained about the user by the exercise machine and/or the backend. For example, the triggers for determining whether to prescribe calibration may be provided by the user via a user interface, where the exercise machine determines whether to prescribe the calibration set based on the user input. The user may also explicitly request that a calibration set be prescribed. For example, the user may indicate via a user input, their change in injury status. The user may also indicate a last time that they exercised. The exercise machine may also automatically detect changes in user ability or automatically determine an amount of inactivity, and automatically determine that recalibration should be performed.

Parameter Selection. In one embodiment, the progressive strength calibration engine takes as input the following example parameters:

- Low weight: In one embodiment, the low weight is the weight that a user starts at for a calibration set. In one embodiment, the low weight is an estimate of what the user is able to easily do;
- High weight: In one embodiment, the high weight estimates a very challenging weight for the user. In one embodiment, a high weight determines how quickly the weight increases during progressive strength calibration; and/or
- Reference speed: In one embodiment, the reference speed (also referred to herein as the "target" speed) estimates a speed slightly below what the user would normally do during the concentric phase of a rep. In one embodiment, the reference speed is tunable. In one embodiment, different movements/exercises have different reference speeds. In one embodiment, the reference speed is personalized for a given user. For example, for some moves, people move faster or slower. If the person is determined to be of a type that moves fast, then the reference speed is made a higher value.

The various parameters used to determine the progressive strength calibration are dynamically adjustable. For example, the parameters are adjustable by movement and/or user.

In the example of FIG. 4, the calibration parameters are determined by calibration parameter determination engine (424) of backend (406). In other embodiments, the calibration parameters are determined by exercise processing engine (408), and/or a combination of both backend (406) and client exercise machine (402).

In one embodiment, the parameters are determined based on whether there is historical information about the user (e.g., stored in user data store (426)). For example, if there is historical information about the user (e.g., the user has performed the move for which progressive strength calibration is being performed), then that information is used to determine personalized low/high weights and personalized reference speed. For example, if there is a large amount of information known about the user (e.g., there is historical information for the user from having performed other sets), then the range of weights (difference between high weight and low weight) can be narrowed.

As one example, the exercise machine determines, with 95% confidence, that the user's strength is between two weights. Those two weights are set as the low and high weight parameters for the progressive strength calibration mode. Further details regarding parameter determination are described below.

In comparison to a new user (for which, as may be described in further detail below, a wider range of weights is evaluated), in this example, the strength of the user may be assessed much more quickly, such as within one or two repetitions (as the range of weights to assess is narrower). In this way, a smaller proportion of the set is used to determine an estimate of the user's strength, with a larger proportion of the set being at an appropriate weight for the user, allowing them to have a more effective workout (whereas if nothing is known about the user, the first several repetitions may be too easy for the user, but not enough is known about the user to provide a more targeted starting point).

If there is no historical information about the user, demographic information may be used. For example, the user may provide, via a UI (e.g., during onboarding), information about themselves. This demographic information may be compared with global information for numerous other users to determine the low/high weights and reference speed.

In some cases, there may not be any information (demographic or historical information) about the user with which to determine the calibration parameters. This may be because the user is using the machine in the context of a demo (e.g., at a store, trying out the exercise machine, where the user does not provide any information about themselves). In this case, a set of default calibration parameters is used. As one example, suppose that the user is a brand new user, and the exercise machine does not have any information about the new user. In this example, the low weight is set very low, and the high weight is set very high. This results in a large range of weights. The progressive calibration mode may accelerate through the entire range, eventually settling on a weight. Further details regarding determining default calibration parameters are described below.

In one embodiment, the progressive strength calibration parameters described above may be selected or adjusted based on the type of condition that triggered prescription of the progressive calibration mode. In one embodiment, the parameters are adjusted based on the combination of both the type of trigger, as well as historical and/or demographic information about the user.

For example, suppose that the user is performing a bicep curl, and has previously performed them before. The exercise machine determines, based on the user's past performance, a certain low/high weight and reference speed.

The exercise machine further determines, based on a record of when the user last used the exercise machine, that it has been several months since they used the machine. Based on the amount of time away from the machine, the exercise machine further adjusts the low/high weights (e.g., by reducing the low weight by a percentage that is determined based on the amount of time away). In this way, the exercise machine is able to determine an estimate of the user's variation over time. Further, the various triggers may indicate lower confidence in the use of historical information to determine calibration parameters, and thus trigger recalibration by the exercise machine.

Thus, based on a variety of factors, the exercise machine determines the calibration parameters for the user (e.g., the personalized calibration parameters to be used in the strength calibration algorithm). In this way, the user may be closer to the appropriate weight from the beginning of the calibration set, and the increments by which the weight is progressively increased are smaller. This improves the workout efficacy of the calibration set (rather than, for example, starting with a very low weight, where the first several repetitions are too easy for the user).

In one embodiment, the weight begins at a value that is the best estimate of a challenging weight rather than the low weight. The weight then dynamically, and in real-time, increases and decreases within an estimated range of appropriate weights as a function of the user's performance during the set. Since the weight starts at a weight that is likely very close to the appropriate weight, it can be used regularly and more broadly rather than only as a calibration. For example, if the user last performed a movement at 50 pounds but has not worked out in a way that is tracked in a month, then the most likely estimate (starting weight) may be 45 pounds, the low weight 40 pounds, and the high weight 55 pounds, as determined using the techniques described herein and population-level data about people's strength changes over time. If the user performs well (e.g., because they worked out without tracking during the month), then the weight would increase from 45 pounds until their performance degrades and the weight is determined to be sufficiently challenging.

Further details regarding progressive strength calibration parameter selection are described below.

Swapping in a Calibration Set. In one embodiment, the calibration set is integrated into the programming of a workout routine. For example, rather than being a standalone calibration mode, the calibration set for a movement replaces a first set (or any other set) of that movement in a workout routine. In this way, the calibration set naturally and seamlessly fits into a workout routine that a user is performing.

Via the progressive strength calibration control described below, not only is an accurate estimate of the user's strength determined, but it is determined in a manner that still allows the user to have an effective workout. In one embodiment, the replacement is performed during onboarding, when the user is performing a new, first workout. Various sets for different movements in the routine may be swapped out for calibration mode sets.

In one embodiment, swapping in of a calibration set is performed when building a workout timeline. For example, when the timeline is being received or obtained (e.g., from the backend), calibration prescription engine (420) of workout engine (418) determines for which movements calibration should be performed. For certain sets of movements, the progressive calibration mode is turned on, which causes the weight for that set to be adjusted, and corresponding measurements taken, according to the progressive strength calibration algorithm described herein.

As described above, in one embodiment, the parameters are determined by the backend (e.g., personalized by the backend based on the user's history, which is stored in the backend server), and then provided to the application on the exercise machine as part of the timeline.

In one embodiment, after it has been decided that recalibration should be prescribed, and the calibration parameters are selected or otherwise determined for the calibration set, the calibration parameters are sent from exercise processing engine (408) to progressive calibration engine (422) (e.g., implemented in firmware) at the start of the calibration set, where the firmware is configured to control the resistance provided by the motor according to a function that takes the calibration parameters as input. Further details regarding the strength calibration algorithm implemented in the firmware may be described below.

In other embodiments, the recalibration may also be used as a standalone test. For example, on a periodic basis (e.g., every two months), the users accept a challenge to determine their strength. A calibration set is prescribed to obtain an estimate of how the user is currently doing. The tests may be prescribed over a period of time, with the results evaluated to determine an improvement in strength of the user.

Execution of a Progressive Strength Calibration Algorithm. As may be described in further detail below, performing progressive strength calibration includes increasing weight during the concentric phases of repetitions as a ramp, to cover the range of weights defined by the low and high weight parameters. For example, while the user is in a concentric phase of a repetition, the weight or resistance applied is increasing as the range of motion increases. Further, in one embodiment, the rate at which the weight increases also increases as the set continues—that is, the weight is accelerating.

In the progressive strength calibration, weight is added progressively. This includes adjusting the resistance provided in increments or steps, where the weight is adjusted over time. In one embodiment, this includes defining an amount of weight to add per unit step or stage. This includes defining an amount of weight to add or reduce per unit time (e.g., rate of weight change).

For example, existing isokinetic techniques are fast controllers that quickly adjust weights to force a user to move at a certain fixed speed and be kept there. By contrast, in the progressive calibration algorithm described herein, even if the user goes above the reference speed, it may take several repetitions before the weight is adjusted to a point that the user's speed is reduced back down to the reference speed (rather than, for example, milliseconds, as in existing calibration techniques).

As described above, in one embodiment, the progressive strength calibration engine is configured to determine a rate of weight change (during a concentric phase of a repetition). The rate of weight change is determined based on a number of components, and may change over the course of the calibration set.

For example, the progressive strength calibration determines the appropriate challenging weight for a user over the course of a calibration set. The progressive strength calibration gradually and continuously increases the weight until the user's speed reduces, and then hones in on the appropriate weight with smaller increases and decreases.

The progressive strength calibration provides improvements to the user experience, such as that the progressive strength calibration:

- is safe and/or safer than traditional calibration techniques;
- works well if the user is not warmed up by gradually increasing the weight;
- does not push the user to failure, and reduces the weight when the user begins to struggle;
- feels mostly like normal weight; and/or
- is easy to do correctly, improving the resulting predictions of weights for the user for this and other movements.

In one embodiment, the weight changes during concentric phase (in one embodiment, the weight in the eccentric phase is constant) at a rate (e.g., pounds per millisecond, or lb/ms) that varies depending on the user's motion. The rate may be expressed in other units in one embodiment. In one embodiment, the rate has two components that, in the below example, are summed.

- Constant, a fixed amount of weight change per second depending on whether or not the speed is above or below the target speed ("constant_1" in the below example progressive strength calibration code); and
- Proportional to the difference between the measured and target speed times a scaling factor ("constant_2" in the below example progressive strength calibration code).

In one embodiment, the rate of weight change also increases as more reps are completed, such that the total weight or resistance appears to "accelerate" upwards under normal usage. The following is a simplified example of code for determining the rate of weight change in the progressive strength calibration mode described herein.

```
Rep_scaling=1+rep_count*0.6//scalar
Constant_1=1e-7*(high_weight-low_weight)//lb/ms
Constant_2=7.5e-5*(high_weight-low_weight)//(lb/ms)/(inch/sec)
If (speed>target_speed): weight_per_ms=rep_scaling*(Constant_1+(speed−target_speed)*Constant_2)
Else: weight_per_ms=−1*rep_scaling*Constant_1
```

As described above, there are at least three input parameters that are provided for each calibration set (or set that has progressive calibration mode prescribed). As described above, the input parameters to the progressive strength calibration algorithm include:

- Low_weight (per trainer arm). In one embodiment this is an estimate of what the user can easily do (this may also be the starting weight for unknown users);
- High_weight (per trainer arm). In one embodiment, this estimates a very challenging weight for the user; and/or
- Target_speed (per trainer arm). In one embodiment, this is a reference speed that estimates a speed that is slightly below what the user would typically do during concentric phase.

As shown above, the components are weighted by factors, where at least some of the factors are based on a proportion of the difference between the high and low weights. For example, if the range of weights to cover or assess is a narrow band, then the weight needs to increase quickly (as compared to a set that has a larger range).

As shown in the example above, by contrast to existing isokinetic calibration techniques that are purely speed-based, the progressive strength techniques described include a component in which the weight applied is independent of the speed, and a distribution of weights to be assessed is defined and progressively evaluated throughout the course of the calibration set.

Scaling by Repetition Number. As shown in the above example, one component of the progressive strength algorithm is the number of repetitions. As more repetitions are performed (indicating the user's progress through the set), the rate of weight change increases. In one embodiment, the range of weights to be assessed (difference between high and low weight parameters) is distributed across the number of repetitions in the calibration set (and may be more specifically, across the aggregate concentric phases of the repetitions.)

Scaling by the repetition number, as shown in the example above, facilitates covering a wide range or distribution of weights where a user may end up (where their challenging weight for the movement is) without having to increase the weight too quickly.

This scaling is analogous to compound interest, but in this case, the weight increases according to an exponential function, where there is a percentage increase from one repetition to the next. This is in contrast to using, for example, a linear function where the weight is increased proportionally every repetition.

For example, suppose that the user's correct weight for performing an exercise is 12 pounds, and strength calibration is performed to identify that weight of 12 pounds. If the weight were increased proportionally for every repetition, without variation based on the repetition number, then given a 10 rep set, with low and high weights of 10 pounds and 50 pounds, respectively, with a 40 pound difference, the weight would be increased by 4 pounds every repetition. Thus, by the second repetition, the weight is increased to 14 pounds. In this case, the user would have only performed half a repetition before resistance provided exceeded their abilities.

Thus, using the techniques described herein, the weight is gradually ramped up so that the user's appropriate weight is identified after several reps, and for a particularly strong user, their maximum weight may be determined later on in the set (e.g., at repetitions 9 or 10).

Using the techniques described herein, the level of accuracy is, for example, percentage-based for every user, and smaller differences in weight at the lower end of the range may be identified. In this way, equal accuracy is provided for various kinds of users (e.g., both strong and weak users). For example, the weight is increased 10% for a user from repetition to repetition, but at a higher weight later on, versus a lower weight earlier on in the set.

Reference Speed. As also shown in the above example, another component of the progressive strength calibration algorithm is speed-based. For example, as shown in the above code, the rate of weight change depends on whether the user's speed is above or below the target/reference speed (as shown, for example, in the If/Else statement in the above code). Further, as shown in the above example code, in one embodiment the rate of weight change is determined based on the difference between the user's speed (e.g., as measured based on change in cable position over time) and the reference speed.

Above Reference Speed. In one embodiment, the higher the user is above the reference speed, the greater the amount of weight added. In one embodiment, while how much higher the user's speed is above the reference speed determines at least one component of the extra weight that is added during a repetition, the majority of the additional weight is not a component of the amount of speed difference, but whether the user's speed was above or below the reference speed. This accounts for the variation in the speed at which different users perform exercise movements. For example, different people have different habits, where some people prefer to do repetitions slowly, even if the weight is light, while others may prefer to do their repetitions quickly.

Below Reference Speed. In one embodiment, if the user is below the reference speed, the amount of weight is reduced. This is based, for example, on a determination that the user's maximum strength is close to being reached (which is why the user's speed is below the reference speed). In this way, the weight is not increased as much. If the user then further continues to do repetitions and they go above the reference speed, the weight may increase, but at a slower rate. That is, the weight had been accelerating (in the increasing direction), was then stopped, and is then allowed to increase gradually if the user continues to do well.

In one embodiment, after the first time the weight is reduced because the user went below the reference speed, the rate of weight change also decreases (e.g., becomes a smaller positive value). In one embodiment, the speed reduction is in two parts. For example, for a first portion of the reduction, if the user's speed is below the reference speed, then the resistance or weight is reduced by a fixed amount over a next time period (e.g., for the next timestep). For the second portion of the reduction, the resistance is reduced further based on the amount by which the user's speed is below the reference speed.

In one embodiment, as the weight is being reduced, how much the weight has been reduced by is tracked. To filter out false positives, this amount of weight is assessed (e.g., where the weight may be reduced because the user paused for a brief period, and then continued). For example, the rate at which the weight increases is slowed if the user has had their weight reduced significantly.

In one embodiment, if the user slows down and speeds up again, the weight is not increased as quickly as previously, as it is determined that the user's maximum weight is being approached, and they were not able to lift the weight at the reference speed.

In one embodiment, reducing the weight includes reducing the high weight parameter. This changes the range of weights that are assessed over the calibration set, and which also causes the rate of weight change to be varied.

Sensor Measurements for Speed. As described above, the progressive calibration is based on the measurement of the user's speed, which as one example is determined from sensor measurements on the change in cable position.

In one embodiment, the measurements of cable speed that are used for the progressive calibration are measurements taken during the concentric phase of the repetition, where the progressive weight changes are applied only in the concentric phase. In one embodiment, during the eccentric phase, the weight is kept constant at the weight that the previous concentric phase ended at. That is, the progressive strength algorithm described above is not applied during the eccentric phase. The last weight in the previous concentric phase is held constant until the next concentric phase starts.

In one embodiment, the progressive strength calibration and motor control are performed in real time. For example, during the concentric phase, cable speed measurements are taken periodically (e.g., at 50 Hz, or every 20 milliseconds), and at every time step, the weight is progressively adjusted.

If, during the concentric phase, the user is above the reference speed, then additional weight is added. As described above, another component of the progressive strength calibration is the amount that the user is above the reference speed for the previous timestamp (e.g., in an average manner), which, as one example, is multiplied by a gain factor to further determine how much more additional weight to add. Thus, the amount of weight or resistance to provide is continuously computed through the concentric phases of the repetition in the calibration mode set.

In one embodiment, the exercise machine determines that the first concentric phase is occurring/has occurred if the user's speed is above a threshold speed.

While in the above examples, the weight was progressively adjusted during the concentric phases of the repetitions in the calibration mode set to assess the user's strength, the calibration techniques described herein may be variously adapted to estimate the strength of a user by progressively adjusting the weight during other phases of a rep, such as during the eccentric phase.

Progressive Strength Calibration Output. The progressive calibration engine is configured to provide various types of output based on the (re) calibration using the progressive strength calibration mode described herein. The calibration mode set includes a number of repetitions. For example, the set may include 10 repetitions. Other numbers of repetitions may be used in a calibration set. The calibration set ends after the predefined number of repetitions is completed.

In this example, an estimate of the user's strength was determined by progressively increasing the weight over a number of repetitions, and observing the user's speed relative to the reference speed. As one example, suppose that the calibration set includes 10 repetitions. Here, the estimate of the strength is the user's 10-rep max or other N-rep max equivalent value (that is, not a one-rep max, but a maximum for performing a different number of repetitions). That is, an N-rep maximum is determined that is a challenging or maximum amount of weight that a user can counter for the defined number of repetitions of the exercise movement (e.g., the heaviest weight the user can act against for N-consecutive repetitions).

In one embodiment, the N-rep max is determined as the final weight applied to the last repetition during the calibration set. In one embodiment, the N-rep maximum estimated as a result of the calibration set is converted to a one-rep max, where the one-rep max is a fraction of the N-rep max estimate.

In one embodiment, the conversion is performed according to a mapping. One example of a mapping is one that maps a number of repetitions to a percentage of the one-rep maximum. The mapping may be a linear function, an exponential function, etc. Different mappings may be used for different types of moves and people.

The following are further examples of outputs and actions that are taken based on the progressive strength calibration described herein.

For example, the output of the calibration mode set (e.g., the N-rep strength estimate for the user) is used in various embodiments. For example, the strength estimate is used to determine suggested weights for future sets/repetitions of the given exercise or movement for which strength calibration was performed.

As another example, various measurements taken during the performance of the calibration set are stored. For example, the N-rep max weight (or final weight or resistance applied or assessed during the calibration set) is stored. This N-rep max is the estimate for the most challenging weight the user can perform for a set including N reps of the movement.

The max weight per repetition is stored for every repetition performed during the calibration set. In one embodiment, the set of measurements is associated with a flag indicating that the set to which these measurements belong is a calibration set.

In one embodiment, a data structure (e.g., table) is generated for storage of data pertaining to calibration sets. For example, for each calibration set, in addition to the aforementioned measurements determined during a given calibration set, the calibration parameters (e.g., the low/high weights and reference speed) that were selected for the calibration set are also stored to the record for the given calibration set.

The results of the calibration may also be displayed or otherwise presented to the user. For example, the one-rep max (e.g., converted from the N-rep max) may be displayed to the user.

The progressive strength calibration mode described herein provides various benefits, one of which is that by gradually increasing the weight across the repetitions in the set, the user experience is improved, and is more akin to performing a regular set.

By contrast to traditional isokinetic calibration techniques, the progressive strength calibration described herein does not require force-velocity curves. This provides an improvement of a simplified and more accurate calibration, where in the progressive calibration mode, samples are taken and feedback is applied in order to arrive at an estimate of the user's strength. Furthermore, the progressive strength calibration techniques described herein provide increased safety, in that a metric such as a one-rep max is estimated without the user having been made to perform an actual repetition at the one rep max weight. Rather, the user performs up to their N-rep max (where N is greater than one, and where N is selected, for example, to match the number of repetitions that would be performed in a regular, non-calibration mode set in a workout routine).

Furthermore, the progressive strength calibration techniques described herein are usable to estimate a suggested weight or ideal weight for a set of exercises with multiple repetitions, which is useful, as users typically do not perform a set where all the repetitions are at their one-rep max. By using the techniques described herein, an appropriate weight for a set with any number of repetitions may be determined.

For example, if the calibration set included 10 repetitions, then the progressive calibration is used to determine a 10-rep max (or some other equivalent), which is a desired weight to suggest to a user when performing sets with 10 repetitions of the exercise.

As described above, the 10-rep max may be converted to a one-rep max (which provides a standard measure, and may be stored as the state for the user's suggested weight). If the user then performs a set of the exercise with 15 reps, the one-rep max is converted to a 15 rep max (e.g., by using the mappings described above). That is, the one-rep max determined from the calibration may be adjusted for sets with varying numbers of reps.

In the above examples, the amount of resistance to provide throughout strength calibration is determined automatically. In one embodiment, the user is able to manually control the progressive calibration mode. For example, the user manually lowers or raises the weight (e.g., via buttons, vocal commands, or other types of user input) until it is at a suitable point for the user. In one embodiment, rather than the exercise machine determining the appropriate weight for the user, the user may indicate (e.g., through user input such as button presses or vocally) whether they have reached an appropriate weight. For example, the weight is continually and gradually increased while the user provides explicit feedback, while lifting, via button presses, gestures, or speaking. For example, the user may press one button to increase the weight and another to decrease it until they feel the weight is appropriate and challenging, or the weight may increase until the user says the word "stop".

As shown in the examples and embodiments described above, using the progressive calibration described herein, an appropriate or ideal weight or resistance to provide for a given exercise is determined by progressively increasing the weight and sampling the speed, where the speed is used as feedback to further settle on or arrive at the ideal weight for the user.

Strength Calibration for Bicep Curl Example. The following is an example of performing progressive calibration for a bicep curl. In this example, suppose that strength calibration is to be performed on a new user for the bicep curl move.

In this example, suppose that the new user has created a new account, and has provided some demographic information about themselves as part of creating the new account. The user would like to perform a workout routine that includes sets of bicep curls (among other movements). As described above, the exercise machine, based on a variety of indicators (e.g., that they are a new user), determines that for a given exercise, rather than having the user perform the exercise in a normal mode, switch to a progressive calibration mode for the first set of bicep curls in the workout routine. In this way, rather than having a user perform a set of standalone calibrations for a variety of exercises, the user is calibrated in the course of performing a workout, by swapping in a calibration mode set.

In this example, the calibration mode is prescribed because the user is a new user. In one embodiment, the user is notified that they are being switched to a calibration mode version of a set. In one embodiment, the user has the option to indicate that they do not wish to perform a calibration mode version of the exercise.

In this example, the demographic information provided by the user is used to determine the parameters for the progressive strength calibration. For example, the demographic information known about the user may be used to select a narrower range of the low and high weight parameters (as compared to, for example, default calibration parameters that would be used if there were no information about the user at all).

In this example, the low weight is set at 10 pounds, as this is determined to be a weight the majority of individuals in the user's demographic should be able to lift. In this example, the high weight is set at 50 pounds. In this example, the reference speed for the bicep curl is set at 20 inches per second, where, for example, the reference speed is set at a lower end of what a person matching the user's demographic profile would typically perform the bicep curl at.

The user then begins performing repetitions in the calibration set. In this example, the first repetition begins at the low weight parameter of 10 pounds. The second repetition is at a higher weight. The amount of weight increases from repetition to repetition in order to cover the range of weights defined by the low and high weights (which are the end points of the range). The amount of weight increases according to a function (e.g., exponential, quadratic, etc.) of the parameters, such as the example progressive strength calibration algorithm described above.

As described above, the rate of weight change increases as the user progresses through the set. That is, the changes in weight from repetition to repetition increase the more repetitions that are performed. For example, if the person performs well in their first repetition, and is above the reference speed, then the weight is increased from 10 pounds to 12-15 pounds for the next repetition, and if that repetition is performed well, then the subsequent repetition may be at 16 or 18 pounds. The amount of weight increase may continue to grow (e.g., the rate of weight change increases, so that the increments in weight change are larger at each step as the calibration progresses), and after several more repetitions, the weight may be set at 30 pounds, before slowing down (e.g., as the user gets closer and closer to the reference speed). That is, the weight adjustment increments become larger and larger as the user progresses through the calibration mode set. At the conclusion of the calibration set, the final weight is determined, for example, as the 10-rep max for the user when performing bicep curls. Various outputs and actions may be taken based on the progressive calibration, as described above.

Figure 5:
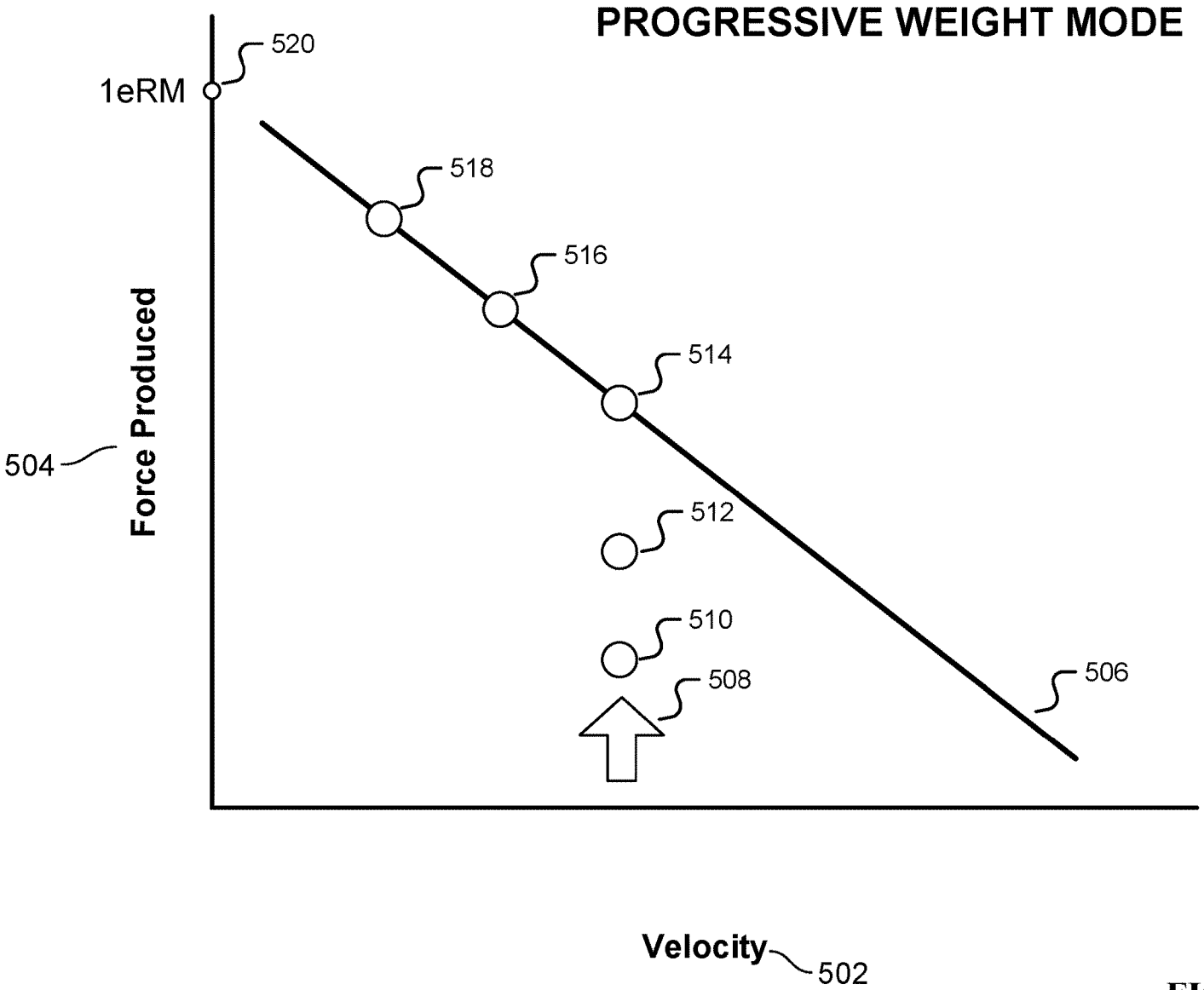
FIG. 5 is an illustration of progressive weight mode.

FIG. 5 is an illustration of progressive weight mode. As detailed above, progressive weight mode is a technique to discover how much weight a strength training user is capable of lifting for a given movement. The progressive weight mode commences by having the user lift a smaller weight to calculate their comfortable velocity. The progressive weight mode then gradually increases the weight until the user slows down by a threshold percentage. If they slow down too much, the weight is decreased until an appropriate weight is determined. In one embodiment, the technique of FIG. 5 is carried out by the system of FIG. 4, including by the exercise machine (402) such as calibration prescription engine (420) and/or progressive calibration engine (422), the backend (406) such as calibration parameter determination engine (424), and/or a combination of such components.

As shown, FIG. 5 is a two-dimensional with an x-axis along movement velocity (502) and a y-axis along force produced/weight exerted (504) for that movement. For a given movement, a near linear relationship (506) may be used, a curve relationship (506) may be used, and/or via empirical studies one or more FVP theoretical curves (506) may be plotted in general for a typical human being, or for a typical human being of a given age, sex, and/or other demographic/physical characteristics.

The progressive weight mode commences (508) by starting a user off at a low weight and measures their velocity (510). Note that in theory, the user could move the weight faster according to the relationship (506), but the progressive weight mode accommodates the tendency for humans to reach a comfortable velocity rather than maximum possible velocity for easier weights.

The progressive weight mode then increases the weight of the movement (512), but again as the user considers this easier and/or well within their capacity, the user maintains near the comfortable velocity established earlier (510). At some point, the progressive weight mode has increased weight to a point (514) that it may be located along a user's force velocity curve/relationship (506). That is, any further increases in weight leads to a slow down in velocity at point (514).

The progressive weight mode then increases the weight of the movement (516), recording that the user begins to lower velocity as weight increases. Eventually (518) the weight has increased enough that the user has slowed down by a threshold percentage, and at this point the progressive weight mode stops increasing weight.

Overview. Progressive weight mode is based on understanding a user's velocity at which they are comfortable lifting at a natural velocity, such as the velocity (508) demonstrated with lower weights (510), (512), and (514), which is also referred to herein as the user maximum velocity and/or user maximum concentric velocity. Progressive weight mode then increases the weight gradually until their velocity decreases below a certain threshold of their comfort/natural velocity. An improvement of progressive weight mode is that it is intuitive: As weight goes up, the user moves more slowly, and as the weight goes down they are able to move more quickly. Thus progressive weight mode starts a user (508) out on a really low weight so that most users will pull at their natural/comfort velocity.

The progressive weight mode then calibrates around that speed and increases weight until their specific force velocity curve (506) is determined, which may vary for different users. Different users have different profiles, for example there are users who can lift a lot but very slowly, users who lift low weights very quickly, and so on, each reflecting a different relationship (506).

Progressive weight mode may then track along the relationship (506) line until the user has slowed down enough that the model has assessed their capacity (518) at the threshold percentage of the natural velocity (508). From those measurements the relationship (506) may be extended to the y-intercept of the graph of FIG. 5, to determine a 1eRM for the user for the movement.

Refinements. During a concentric phase, users may show some variation and/or fall below their target speed, even on a rep where they eventually crest above it. One example is if a target speed is 50 inches per second, and a user varies between 40 inches per second and 60 inches per second at the beginning of the rep. To avoid spurious results for the time the user is beneath 50 inches per second, during part of a user's beginning of the rep, when the user is below the target speed, there is an opportunity to regain that weight lost at an accelerated schedule.

For example, at the beginning of a rep a user may lose a tiny bit of weight but as the user hits their maximum speed, they exceed the target speed. The progressive weight mode may be refined to not only gain the weight the user is supposed to, it may also regain the weight that the user lost in that beginning phase.

Weight calculations may be refined beyond a multiplicative function for weight increases. Traditionally, if a user were at 20 pounds and performed their rep correctly, a system may increase weight by 20 pounds multiplied by 10%, for example. Refinement using additive functions and/or other functions for weight increases may be used. Thus instead of a multiplicative function the mode may pre-calculate how much weight the user is allowed to gain for each rep which may dynamically increase over a duration of user reps. Thus at the beginning of the rep a user may be allowed to gain 3 pounds, 4 pounds, but as the rep progresses that allowance may increase from 5 pounds to 7 pounds to 8 pounds to 15 pounds to 20 pounds. This weight increase may resemble a curve and/or use piecewise linear relationships.

In one embodiment, a dampening function is used for refinement. For example a user may be lifting 10 pounds comfortably but when they increase weight to 20 pounds they cannot manage at all, leaving the system to drop back down to 10 pounds which eventually pushes them back to 20 pounds. A dampening function recognizes this active bouncing or "ping-ponging" and may narrow down how much weight a user is allowed to gain. In the example above, the user may go from 10 pounds comfortably to stall at 20 pounds, then return to 10 pounds but when comfortably increasing this goes to 18 pounds. If 18 pounds is still stalling it may go down to 12 pounds, back up to 17 pounds, and then down to settle at 15 pounds.

Improvements of Progressive Weight Mode over Isokinetic Mode. From a user experience perspective, an isokinetic mode as shown in FIG. 2 may increase weight more aggressively than may seem natural and/or comfortable to a user. By contrast, the improvement of progressive weight mode is that it more closely resembles a typical weightlifting exercise routine unlike the more divergent experience of using an isokinetic movement. While weight increases from (510) through (518) in FIG. 5, a progressive weight mode may be slotted into any typical workout to assess a user's strength whenever necessary. This provides a "cold start" assessment, described herein as one that may be used for a user with no previous history. An improvement of cold start progressive weight mode is that an understanding of the user may be assessed without injury to the user and/or while keeping the user comfortable/natural.

Another improvement is that the progressive weight mode is capable of finding a target speed, referred to herein as the lower speed of the mode shown at point (518) in FIG. 5. The target speed is where a user ends the progressive weight mode; by contrast isokinetic mode may require a target speed that is manually inputted and/or based on demographics or other empirical data. The improvement with progressive weight mode is that the target speed is determined for the individual user.

For example, if a user lifts at 50 inches per second and a threshold is determined to be 35 inches per second, then the progressive weight mode increases weight gradually until the user reaches 35 inches per second to record how much weight was being lifted at that point. In one embodiment, an aggregation is used such that if a user dips below a point but then goes above a point, a more accurate measurement may use statistical relationships and/or machine learning to determine the relationship (506) and/or 1eRM (520) from the aggregate measurements.

Thus, the target speed is a threshold percentage of the user maximum concentric velocity. During a concentric phase a maximum velocity is established (508) and the target speed is set as a percentage of that velocity, such as 72% of that maximum velocity. A range for target speeds can be utilized such that, for example, if a user moves faster than 72% of their maximum speed their weight is increased, and if they move slower than 65% of their maximum speed their weight is reduced, and if they move between 65 and 72%, their weight is maintained. In one embodiment, minimum and maximum target speeds are established to avoid penalizing a user who just happens to make a jerky fast motion that they are unable to replicate, or for a user who moves incredibly slowly, outside the bounds of the general distribution of the population.

For example, a user may pull on a movement extremely hard, way faster than they might normally pull, for example 200 inches per second. Normally, a personalized target speed would then be 150 inches per second, but that might be an unsustainable goal for the user, such that if the user were to try and lift that as the weight goes up, they wouldn't be able to keep up. The progressive weight mode may compute/aggregate over multiple movements and/or provide a demographic maximum target speed so that even though the user lifted at 200 inches per second, the demographic maximum may be 50 inches per second which is less than 150 inches per second, establishing the user's target speed at 50 inches per second.

Figure 6:
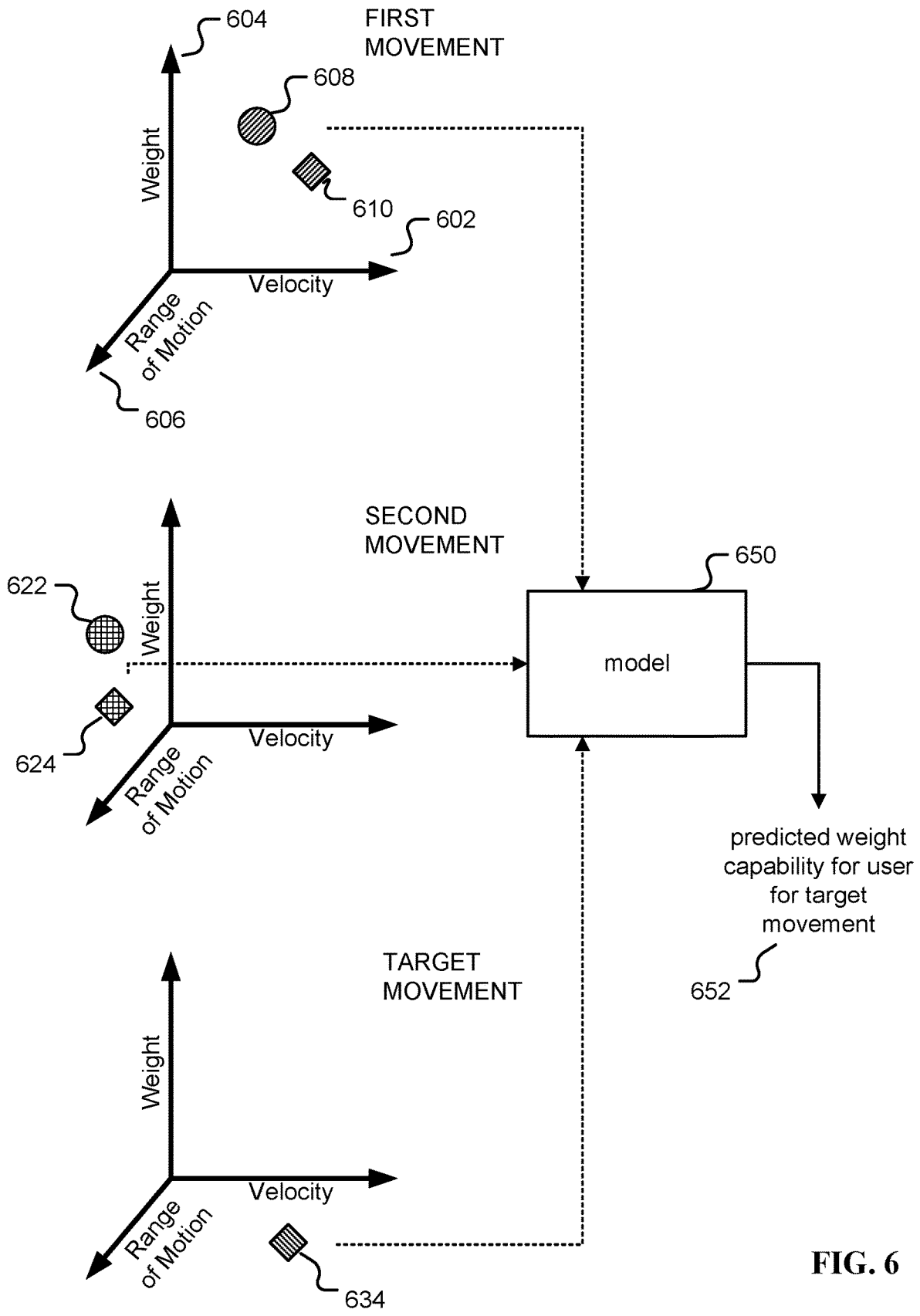
FIG. 6 is an illustration of a velocity and weight recommendation model.

FIG. 6 is an illustration of a velocity and weight recommendation model. In one embodiment, the technique of FIG. 6 is carried out by the system of FIG. 4, including by the exercise machine (402) such as calibration prescription engine (420) and/or progressive calibration engine (422), the backend (406) such as calibration parameter determination engine (424), and/or a combination of such components.

A velocity and weight recommendation model is a model that may calculate a user expected weight capacity on an exercise movement that a user has not been observed to perform by analyzing performance on previous exercise movements. As shown in FIG. 6, a model may include any input/output model that takes as input features and produces as output labels, such as a machine learning model.

In one embodiment, an input feature of user-specific performance information captured for a previously performed movement is used for a velocity and weight recommendation model. As shown in FIG. 6, performance information may be expressed as multi-dimensional information. For example and without limitation, three-dimensional axes of performance information may include a user's movement velocity (602), a user's weight while carrying out the movement (604), and the range of motion of the user's movement (606). Thus a user's first set of performance information for a first movement comprises a first weight, a first velocity, and a first range of motion, depicted in multi-dimensional space as point (608) in FIG. 6. Additional features beyond performance features may be input to the model, for example descriptive features such as features of the performed movement including which movement family it belongs to, a score for how utilized each muscle group is for a given movement, whether movements are performed with one or both arms and/or legs, and a user's age, sex, height, weight, self-described weight lifting experience, and observed weight lifting habits.

In one embodiment, an input feature of population-level performance information captured for the same movement as the user-specific performance information is used for the velocity and weight recommendation model. As shown in FIG. 6, this is depicted in multi-dimensional space as point (610) in FIG. 6 for the first movement. Additional population-level features beyond performance features may be input to the model, for example descriptive features such as averages and/or other statistical features for demographic features.

For example, for a bench press, the user's first set of performance information (608) may comprise a 45 inch/sec bench press at 100 pounds with a range of motion of 75 inches, while the population-level performance information may comprise a 35 inch/sec bench press at 80 pounds with a range of motion of 60 inches.

In one embodiment, a second movement is considered as an input feature to the model. Thus a user's second set of performance information for a second movement comprises a second weight, a second velocity, and a second range of motion, depicted in multi-dimensional space as point (622) in FIG. 6. Similarly, an input feature of population-level performance information captured for the same movement as the user-specific performance information is used for the velocity and weight recommendation model. As shown in FIG. 6, this is depicted in multi-dimensional space as point (624) in FIG. 6 for the second movement.

In an alternate embodiment, the second movement is an optional feature. In an alternate embodiment, a third or more movements are considered as an optional input feature to improve precision and/or accuracy.

Continuing the example above with the first movement being a bench press, for a gobble squat, the user's second set of performance information (622) may comprise a 25 inch/sec gobble squat at 180 pounds with a range of motion of 120 inches, while the population-level performance information may comprise a 30 inch/sec gobble squat at 160 pounds with a range of motion of 90 inches.

The user may select a target movement to start exercising with. The velocity and weight recommendation model may then receive as an input feature a population-level performance information captured for this target movement, depicted in multi-dimensional space as point (634) in FIG. 6 for the target movement.

The velocity and weight recommendation model (650) may then take as input features: user captured performance information for the first movement (608) and optionally a second or more movements (622); population-level performance information for the first movement (610) and optionally a second or more movements (624); and population-level performance information for a target movement (634). The model output label is a predicted weight capability for the user for the target movement (652).

The velocity and weight recommendation model (650) may take performance information from any weight modes, for example the isokinetic mode described in FIG. 2 or the progressive weight mode described in FIG. 5, and determine a suggested weight for a user's target movement.

In one embodiment, the isokinetic mode and/or progressive mode may use a linear combination of a user's one rep max across a few movements. Traditionally, a user may perform four cardinal movements, and then a traditional system takes those four specific movements and determines the user 1eRM based on performance in the user calibration. For example, one movement may have to be an internal shoulder rotation movement to cover all shoulder-related movements. Then to estimate a target movement, an example may be 50% of the 1eRM for the first movement plus 25% of the 1eRM for the second movement plus 15% of the 1eRM for the third movement, plus 10% of the 1eRM for the fourth movement. Thus, using user-specific cardinal movements the system can suggest weights for most possible movements.

By contrast, the improvement of the velocity and weight recommendation model (650) is more accuracy and less number/type of historical movements. The model (650) does not only look at 1eRM as an input, but also accommodates additional feature information such as user velocity, user range of motion, and population distributions of similar metrics. In one embodiment, the model (650) is trained on a vast population of movement sets. In one embodiment, tens of millions of movement sets may be recorded in aggregate across all users that use for example an exercise machine as shown in FIG. 1 and/or (402) of FIG. 4, and/or may be stored in a backend like that shown in (406) of FIG. 4.

For example, where a traditional calibration may require four movements and four specific cardinal movements to cover most possible movements, an improvement of the model (650) is that it may require two movements which can be any two movements with less regard to cardinality. This improvement allows more efficiency as it requires a less number of performance captures and less restrictions in which movements qualify for cardinality. This enables better strength training in that more people can participate and encourage each other in strength training because a new user who is at a friend's house can easily join the friend in a partner workout, with a simple routine of two progressive weight calibration sets at the beginning of the partner workout. The output from the model (650) can then be simply used to predict weights for everything else in the partner workout.

Benefits of calibrating using "any two movements" as opposed to "four specific cardinal movements" include a faster calibration with less effort required from the user, so users can choose to calibrate with the moves they are most familiar and/or comfortable with rather than being forced to perform specific movements. Calibration can be performed using the first two movements of any existing workout rather than requiring a new user to perform a specific calibration workout, and being able to calculate suggested weights using any two movements enables an improvement of a new capability of being able to regularly check a user's weight throughout a workout by computing suggested weights from recently performed movements in order to offer up to date, fine-tuned suggestions.

Another application for model (650) is to accommodate a user's injury or downtime, where a user's strength has been decreased. Recalibration of this decreased strength user is simple with model (650). It may take data from calibration sets using the isokinetic mode and/or progressive weight mode, and may also incorporate any performance of movement, for example from a regular exercise mode. Another application is a detection mechanism if the user were to manually turn down their movement weight, the system (402) may say prompt the user to recalibrate everything because of the manual turn down. Another application is an extended learning mechanism that continually and/or subtly applies the performance weight mode and/or regular exercise mode to collect additional multi-dimensional performance captures to improve the output of model (650). Another application is an extended population learning mechanism that continually and/or subtly applies the performance weight mode and/or regular exercise mode to contribute towards, for example, in aggregate to collect additional multi-dimensional population-level performance to improve the output of model (650). In one embodiment, a user may be able to transfer, using a network or manually, performance information from a proxy and/or remote exercise machine regardless of whether the exercise machine is a digital strength trainer (402) or not. For example, they may be able to input a user coming back from a barbell gym after attaining a bench press of 250 lb with 10 reps in five minutes and twenty-three seconds and a range of motion of 60 inches.

In one embodiment, incorporation of a regular exercise movement can use additional descriptive features in classification. For example, a given user's regular exercise movement workout may be captured for two random movements from a workout and analyzed to see if their performance may be predicted on a third movement from the workout. Similarly for population-level data it may be averaged and/or statistically aggregated, for example what did all users across a study do for a bench press. A digital strength trainer (402) or other trainer may capture information such as mean velocities, the ranges of motion, actuator position, heart rate, demographic features (e.g., size, height, weight, gender, age, etc.), body type (e.g., endomorphic, mesomorphic, ectomorphic, etc.), movement family (e.g., squat, hinge, shoulder rotation, etc.), and other different elements/dimensions of performance information.

In one embodiment, the model (650) is a gradient boosting framework, for example one that uses tree-based learning algorithms. The model is constructed based at least in part on analysis over generation of features, the analysis of features, the technique including ordering of how features are fed into the model, etc. For example, if a user performs a bench press and then a squat it is important to present that data in a proper order as data may be fed in as a vector with its implicit order. Appropriate ordering is used to address any feature order invariance.

In one embodiment, user-specific inputs (608), (622) and population-level inputs (610), (624), (634) are fed into model (650) as vectors. Feature vectors may include the user's weight, velocity, range of motion (608), (622) and the population-level average weight, velocity and range of motion. In one embodiment, for first and second movements a movement family is added as a descriptive feature, for example using an identifier (for example, a squat may be identifier number 14.) Features may be encoded. Other descriptive features such as demographic data, gender, and/or height may be included as well.

A user's captured performance information vector may include a value for each dimension. For example, for weight, the value may be their extrapolated 1eRM. So if a user does 10 reps of 50 pounds for a given movement, it may be determined that they have a 1eRM of 75 pounds. For example, for velocity, the value may be the inches per second of the movement at the point of their maximum concentric power, i.e., the speed for the particular rep at which they are moving the most weight times the most speed. For example, for range of motion, the user's range of motion is during the particular rep which they produced that maximum power.

In one embodiment, a variant may be used. For example, instead of performance information values based on the last rep, the information values may be an average over a set, e.g., average range of motion over the set. Alternately it may be a total over a set, e.g., total range of motion over the set.

A normal use case for model (650) is a user that performs these calibrations and then joins a workout that has moves the user has never performed before. The trainer (402) may then make a call to the model (650) to receive, for example, the ten movements in the workout and determine a weight for each of the ten movements. The model (650) may then be run ten times for the ten target movements A, B, C, D, E, F, G, H, I, and J using two input historical user-specific movements X (608) and Y (622) and appropriate population-level information.

An "average pairwise" variant (650) may be used to incorporate more than two user-specific movements. For example, if a user has completed movements X (608), Y (622), and Z, then the model (650) may have as features a predicted weight for a given first run of model (650) with movement X and Y, then a second run of model (650) with movement X and Z, then a third run of model (650) with movement Y and Z, and then all three output labels may be averaged for greater precision and/or accuracy.

Applications of Model. Traditionally, suggested weights comprise a calibration and a related moves analysis. For example, if a user has done five different squats but not a one-legged squat recently, then detection that the one-legged squat has not been done recently may trigger a review of performance on the five different squat movements and an updated weight recommendation is determined for the one-legged squat.

An improvement using cold start calibration and/or the velocity and weight recommendation model (650) is that it can include this update functionality along with a more continuous updating of weights. In one embodiment, suggested weights may be updated as frequently as every single set a user performs. In one embodiment, significant deviations in user behavior trigger an anomaly detection wherein the user may receive communication with a message indicating an injury is detected and/or a long downtime/absence has been detected and further trigger an update of all suggested weights and/or starting weights. This is an improvement over waiting for a user to manually indicate injury/absence because some injuries may be hard to detect for a user. In one embodiment, the anomaly detection may be used for injury detection and/or medical anomaly detection before a user is aware of an injury and/or medical anomaly.

In one embodiment, any model (650) that has as a fundamental insight that users move at different speeds such that target speeds are not set manually and/or that a user may have a personalized speed is used. Another improvement of using model (650) is that it permits guest workouts and demonstration workouts because of how efficient two non-cardinal movement calibrations are.

By contrast to larger models that may be more performant, using one or two captured user-specific performance information (608), (622) with a small set of features is an improved technological advancement requiring less computational resources, less memory resources, and/or less network resources such that the model (650) can be executed on mobile devices comprising an ARM processor and a smaller memory, while reaching appropriate accuracy. Another improvement that the velocity and weight model (650) enables is velocity-based training comprising a framework within strength training including working out at different velocities. Similarly, indicative of range of motion contributing significantly to the predictive power of the model (650), the model may also enable range of motion-based training features and exercises as well as velocity-based training features and exercises.

In one embodiment, a gradient boosting machine is used for the velocity and weight model (650) to provide efficiency and/or fast response with higher accuracy/precision. Without limitation, other machine learning techniques may be used, for example as a neural network of 50 layers.

In one embodiment, performance information may include weight, velocity, and range of motion. Other possible features include the statistical moments describing power, rep duration, concentric versus eccentric phase duration, inter-rep rest duration; the decrease over the course of a set of velocity, power, and range of motion; scores describing user struggle, inconsistency between reps, user form based on cable data; the estimated user reps in reserve at the end of the set; heart rate data; visual data including calculated form quality, user exertion, and emotional reaction scores based on facial expressions. For users with an established lifting history on the device, the above features could also be included as an average over their recent or entire history. In one embodiment, descriptive features may include muscle family, muscle group, muscle utilization including a muscle utilization vector, and/or muscle type. Other features include demographic features such as user age, sex, height, weight, wingspan, estimated body fat percentage, self-described weight lifting experienced, measured weight lifting patterns.

Training the Model. In one embodiment, a set, for example twelve weeks of workout data, is used for training, one week from each month of the last twelve months randomly. A first block is accessed, wherein a "block" as referred to herein is as follows: if in a workout the user does three bench presses, each one is a set, and the first set of each of the movements is called a block. That's our internal parlance for it. Thus, the first block of each of these workouts over the twelve weeks is reviewed and two movements are selected.

A target movement may be selected for prediction. For all the other movements in the block, a randomly ordered sub-selection of two of those are selected. For example, if there are five movements, movement E is considered the target move, and a 'pairwise selection' process occurs where: first, movement A and C are selected as one pair and E is predicted and compared against the actual E; second, movement D and B are selected as one pair and E is predicted and compared against the actual E, and so on, as each combination is iterated. In one embodiment, a loss function is the 1eRM for weight, a suggested weight, a suggested velocity, and/or a force velocity relationship.

In one embodiment, a loss function comprises a comparison of the predicted weight with the actual trained weight and a squared error and/or root-mean-squared error is used. In one embodiment, a loss function comprises a comparison of the predicted weight with the actual trained weight and a mean absolute error is used.

Thus, these are the basic features calculated for population-level averages for each movement across an entire dataset. After the entire dataset is process, the results are organized into a single vector. Thus, the first and second movements, the target movement, and the population features are organized along with training data and a subset of the data left aside for the purpose of verification with test data to ensure that the model's performing accurately on data never seen before. A "splinter" phase may be used where a set of users are splintered out from those used to test, to randomize the model such that a user would not appear in both training and test.

In one embodiment, population means are used so that a movement is not identified beforehand. For example, a movement may not be identified but a movement family/muscle family is identified, so that even for a movement the model has not seen before in training, with a level of population data, the model can still work. This is an improvement in that the model (650) can be useful even if a new movement is introduced. A 'retraining' phase may be used with retraining on new data for the new movement which may help improve accuracy.

Triggers. In one embodiment, a trigger for using the model (650) is to determine fallback weights at a beginning of a workout. In a progressive mode, as a user works out, their suggested weight is progressively adjusted as the model (650) is further refined. Thus, a progressive update may occur as frequently as before each movement within a workout and for each set, or less frequently. For example, at the beginning of a workout a recommendation of 50 pounds would be suggested, but after a user does a tricep extension at this weight, range of motion and velocity may progressively adjust the recommendation. In one embodiment, the existing calibration framework and/or a suggested weight framework is regularly used for that purpose.

In one embodiment, input vectors for the model (650) are based on a current workout, for example the last four movements may be used to feed the model (650) and compared with current recommendations to determine if they are divergent and/or should be changed. In one embodiment, even prior to a workout for an initial recommendation, a time filter may be applied on getting two movements to only restrict performance information from the last 90 days to find more recent and/or more temporarily relevant information to a user's current condition.

In one embodiment, for other modes a model (650) is set to ignore and/or not train, for example a warmup mode and/or a recovery mode where it may potentially not reflect a user's true capability.

In one embodiment, an injury is detected if a user manually requests a special workout with detectable decreases in weights for two movements. After the two movements have been calibrated, the system detects a large manual decrease and based on the two captured movements may suggest much different weights for every other movement in a workout.

In one embodiment, a weakness is detected, for example because of aging and/or gentle atrophy. For example, if a bicep curl movement is 10% below a user's typical weight, then the model (650) may suggest how this 10% weakness may propagate on a bench press movement and may compare the current value for the bench press if different from a new value calculated. This is one method to recalibrate without the input of a user manually decreasing the weights. A weakness and/or injury may be detected outside of weight, for example with range of motion and/or velocity. For example, some injuries permit a similar weight but with a damaged range of motion. The model (650) can then predict suggested range of motion exercises to accommodate the injury/weakness.

In one embodiment, a trigger is the deviation. Thus if a predicted suggested weight/velocity/range of motion deviates more than a threshold deviation from the actual user performance, the model may be run again to determine a new suggested range of weight/velocity/range of motion, or even new movements or training philosophies, to guide the subsequent workout or subsequent performance of a movement.

In one embodiment, a model (650) is trained to predict velocity and/or range of motion. Thus a velocity-based training feature may determine that the user is going to move at 50 inches per second and then allow different weights at that speed.

Figure 7:
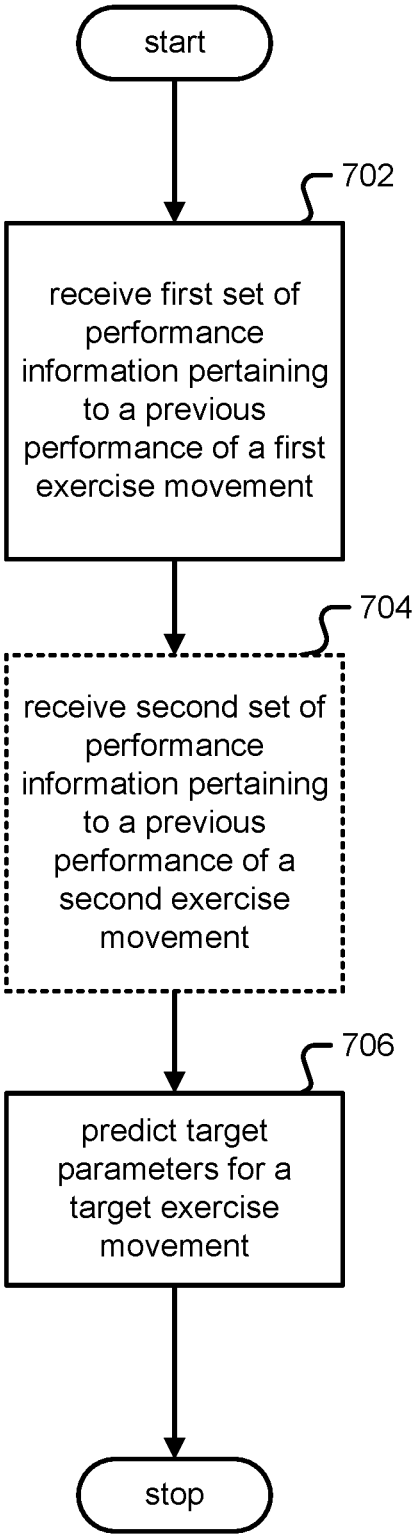
FIG. 7 is a flow diagram illustrating an embodiment of a process for a velocity and weight recommendation.

FIG. 7 is a flow diagram illustrating an embodiment of a process for a velocity and weight recommendation. In one embodiment, the process of FIG. 7 is carried out by the system of FIG. 4, including by the exercise machine (402) such as calibration prescription engine (420) and/or progressive calibration engine (422), the backend (406) such as calibration parameter determination engine (424), and/or a combination of such components.

In step (702), a first set of performance information pertaining to a previous performance of a first exercise movement is received, wherein the first set of performance information comprises a first weight, a first velocity, and a first range of motion. In one embodiment, the first range of motion comprises an aggregate range of motion value across a set comprising performance of a plurality of repetitions of the first exercise movement.

In one embodiment, the first set of performance information comprises an indication of a first movement family that the first movement is included in. In one embodiment, the first set of performance information comprises an indication of a first movement family that the first movement is included in and wherein the target exercise movement is not included in the first movement family. In one embodiment, the first set of performance information comprises a first muscle utilization. In one embodiment, the first set of performance information is associated with a calibration set. In one embodiment, the first set of performance information is received based at least in part on a determination that the previous performance of the first exercise movement is within a threshold period of time and/or time filtered.

In one embodiment, the first weight is associated with a one rep maximum determined for the first exercise movement. In one embodiment, the first weight and the first velocity are associated with a determination from a progressive weight mode for the first exercise movement, wherein the progressive weight mode progressively increases weight for a user at least in part to determine a user force-velocity profile. In one embodiment, the first weight is associated with a determination from an isokinetic weight mode for the first exercise movement, wherein the isokinetic weight mode matches a user applied force at a constant velocity at least in part to determine a user force-velocity profile.

In step (704) denoted as optional by the dotted line around step (704), a second set of performance information pertaining to a previous performance of a second exercise movement is received, wherein the second set of performance information comprises a second weight, a second velocity, and a second range of motion.

In step (706), target parameters for the target exercise movement are predicted based at least in part on the first set of performance information and optionally the second set of performance information, wherein the target exercise movement is different from the first exercise movement (and optionally the second exercise movement). In one embodiment, the target parameters comprise at least one of weight, velocity, and range of motion. In one embodiment, an exercise machine is configured to facilitate performing of the target exercise movement based at least in part on the predicted target parameters.

In one embodiment, predicting is triggered prior to a workout comprising one or more exercise movements to be performed, the workout comprising the target exercise movement. In one embodiment, predicting is performed using a machine learning model, and wherein the first set of performance information is included in an input feature vector to the machine learning model. In one embodiment, predicting is performed using a machine learning model, and wherein a first set of population performance information associated with the first exercise movement is included in an input feature vector to the machine learning model. In one embodiment, predicting is performed using a machine learning model, and wherein an output label of the machine learning model comprises a suggested weight for the target exercise movement.

In one embodiment, the system to process comprises a backend server, and wherein a processor is further configured to transmit, over a network, the predicted target parameters to the exercise machine. In one embodiment, the system to process comprises the exercise machine.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system, comprising:

a processor configured to:

receive a first set of performance information pertaining to a previous performance of a first exercise movement, the first set of performance information comprising a first weight, a first velocity, and a first range of motion;

predict target parameters for a target exercise movement based at least in part on the first set of performance information, wherein the target exercise movement is different from the first exercise movement; and wherein an exercise machine motor torque is adjusted to facilitate performing of the target exercise movement based at least in part on the predicted target parameters and wherein the exercise machine motor torque is associated with user resistance for an exercise machine;

and a memory coupled to the processor and configured to provide the processor with instructions.

2. The system recited in claim 1, wherein the processor is further configured to:

receive a second set of performance information pertaining to a previous performance of a second exercise movement, the second set of performance information comprising a second weight, a second velocity, and a second range of motion; and predict the target parameters for the target exercise movement based at least in part on both the first set of performance information and the second set of performance information.

3. The system recited in claim 1, wherein the target parameters comprise at least one of weight, velocity, and range of motion.

4. The system of claim 1, wherein the first range of motion comprises an aggregate range of motion value across a set comprising performance of a plurality of repetitions of the first exercise movement.

5. The system of claim 1, wherein the first set of performance information comprises an indication of a first movement family that the first exercise movement is included in.

6. The system of claim 1, wherein the first set of performance information comprises an indication of a first movement family that the first exercise movement is included in and wherein the target exercise movement is not included in the first movement family.

7. The system of claim 1, wherein the first set of performance information comprises a first muscle utilization.

8. The system of claim 1, wherein the predicting is triggered prior to a workout comprising one or more exercise movements to be performed, the workout comprising the target exercise movement.

9. The system of claim 1, wherein the first set of performance information is associated with a calibration set.

10. The system of claim 1, wherein the first set of performance information is received based at least in part on a determination that the previous performance of the first exercise movement is within a threshold period of time.

11. The system of claim 1, wherein the predicting is performed using a machine learning model, and wherein the first set of performance information is included in an input feature vector to the machine learning model.

12. The system of claim 1, wherein the predicting is performed using a machine learning model, and wherein a first set of population performance information associated with the first exercise movement is included in an input feature vector to the machine learning model.

13. The system of claim 1, wherein the predicting is performed using a machine learning model, and wherein an output label of the machine learning model comprises a suggested weight for the target exercise movement.

14. The system of claim 1, wherein the first weight is associated with a one rep maximum determined for the first exercise movement.

15. The system of claim 1, wherein the first weight and the first velocity are associated with a determination from a progressive weight mode for the first exercise movement, wherein the progressive weight mode progressively increases weight for a user at least in part to determine a user force-velocity profile.

16. The system of claim 1, wherein the first weight is associated with a determination from an isokinetic weight mode for the first exercise movement, wherein the isokinetic weight mode matches a user applied force at a constant velocity at least in part to determine a user force-velocity profile.

17. The system of claim 1, wherein the system comprises a backend server, and wherein the processor is further configured to transmit, over a network, the predicted target parameters to the exercise machine.

18. The system of claim 1, wherein the system comprises the exercise machine.

19. A method, comprising:

receiving a first set of performance information pertaining to a previous performance of a first exercise movement, the first set of performance information comprising a first weight, a first velocity, and a first range of motion;

predicting target parameters for a target exercise movement based at least in part on the first set of performance information, wherein the target exercise movement is different from the first exercise movement; and wherein an exercise machine motor torque is adjusted to facilitate performing of the target exercise movement based at least in part on the predicted target parameters and wherein the exercise machine motor torque is associated with user resistance for an exercise machine.

20. A computer program product embodied in a non-transitory computer readable medium and comprising computer instructions for:

receiving a first set of performance information pertaining to a previous performance of a first exercise movement, the first set of performance information comprising a first weight, a first velocity, and a first range of motion;

predicting target parameters for a target exercise movement based at least in part on the first set of performance information, wherein the target exercise movement is different from the first exercise movement; and wherein an exercise machine motor torque is adjusted to facilitate performing of the target exercise movement based at least in part on the predicted target parameters and wherein the exercise machine motor torque is associated with user resistance for an exercise machine.

* * * * *